US007037194B2

(12) United States Patent
Seelig et al.

(10) Patent No.: US 7,037,194 B2
(45) **Date of Patent: *May 2, 2006**

(54) METHOD AND DEVICE FOR PLAYING A GAME

(75) Inventors: Jerald C. Seelig, Pleasantville, NJ (US); Larry M. Henshaw, Pleasantville, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/663,396

(22) Filed: Sep. 15, 2003

(65) Prior Publication Data

US 2004/0082377 A1 Apr. 29, 2004

Related U.S. Application Data

(63) Continuation-in-part of application No. 10/184,139, filed on Jun. 26, 2002, now Pat. No. 6,656,043, and a continuation-in-part of application No. 10/027,858, filed on Oct. 18, 2001, now Pat. No. 6,764,396, which is a continuation-in-part of application No. 09/644,279, filed on Aug. 22, 2000, now Pat. No. 6,450,884, which is a continuation-in-part of application No. 09/535,075, filed on Mar. 23, 2000, now Pat. No. 6,338,678.

(51) Int. Cl.
*A63F 7/00* (2006.01)
*G07F 17/34* (2006.01)

(52) U.S. Cl. ..... 463/17; 463/20; 463/22; 273/143 R; 273/144 R; 273/144 B; 273/138.1; 273/138.2

(58) Field of Classification Search ..... 463/20, 463/16, 17, 18, 19, 25, 22; 273/143 R, 138.1, 273/138.2, 144 R, 144 A, 144 B, 136.2
See application file for complete search history.

(56) References Cited

U.S. PATENT DOCUMENTS 5,088,737 A * 2/1992 Frank et al. ..... 463/18
5,628,684 A * 5/1997 Bouedec ..... 463/17
6,764,396 B1 * 7/2004 Seelig et al. ..... 463/17

* cited by examiner

*Primary Examiner*—Benjamin Layno
(74) *Attorney, Agent, or Firm*—Ian F. Burns; Ian F. Burns & Associates

(57) ABSTRACT

The present invention includes a gaming device comprising a game apparatus being adapted to allow a player to play a game and a jumbled ball display device. The jumbled ball display device includes a plurality of display balls, at least one container adapted to hold the display balls, and at least one agitator adapted to agitate the display balls inside of the container. The container preferably includes at least one portion that is at least partially transparent, which allows the player to view the balls in the container. The jumbled ball display device preferably does not affect the outcome of the game played on the game apparatus. The gaming device further includes a prize display in communication with the game apparatus. The prize display is preferably adapted to select a prize ball to convey the outcome of the game and display the selected prize ball. The gaming device also preferably includes a media dispenser in communication with the game apparatus. The media dispenser is preferably configured to dispense media to the player.

51 Claims, 16 Drawing Sheets

METHOD AND DEVICE FOR PLAYING A GAME

CROSS REFERENCES TO RELATED APPLICATIONS

This application is a continuation-in-part application of U.S. patent applications Ser. No. 10/027,858, filed Oct. 18, 2001, now U.S. Pat. No. 6,764,396, issued Jul. 20, 2004, and Ser. No. 10/184,139, filed Jun. 26, 2002 now U.S. Pat. No. 6,656,043, issued Dec. 2, 2003. U.S. patent applications Ser. Nos. 10/027,858 and 10/184,139 are continuation-in-part applications of and claim the priority of U.S. patent application Ser. No. 09/644,279, filed on Aug. 22, 2000, now U.S. Pat. No. 6,450,884, issued Sep. 17, 2002. U.S. patent application Ser. No. 09/644,279 is a continuation-in-part application of U.S. patent application Ser. No. 09/535,075, filed on Mar. 23, 2000, now U.S. Pat. No. 6,338,678, issued Jan. 15, 2002.

FIELD OF INVENTION

The present invention relates to a display device for use with a gaming device that selects one or more balls from a plurality of individually controlled balls and displays the selected ball.

BACKGROUND

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Bonus Prizes

Some gaming devices award bonuses in addition to prizes that are awarded in the primary game. A bonus can be defined as an additional prize that is awarded to the player when a predefined event occurs. An example of a bonus game can be found in U.S. Pat. No. 5,848,932 issued to Adams. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

Generally, bonus prizes are offered in such games in order to increase the excitement and enjoyment experienced by players. This attracts more players to the game and encourages players to play longer. When gaming devices attract more players and the players play longer, they tend to be more commercially successful relative to other gaming devices.

Display Devices

In addition, highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

Display devices tend to be more successful if they are a derivation of a well-known game or theme. They are more successful because players tend to be drawn to games that they instantly recognize. Many players are reluctant to try completely new games because they must spend time to learn the new game. It is, therefore, desirable to provide display devices that are based on well-known games or themes.

Display devices also tend to be more successful if they utilize physical objects rather than simulations. Although video devices and electronic signs can be used for display devices, players are more attracted to display devices that utilize physical objects. Physical objects can be even more effective display devices if they are moveable and they are used in combination with lights and sounds.

Keno

Upon an initial examination, it would appear that the display device of Keno is an excellent choice for a display device for gaming devices. Keno is well known to the playing public, and it utilizes a highly visible and attractive display device. The display device comprises a container with a plurality of numbered balls. The balls in the container are agitated or jumbled, usually by a jet of air, to a state where they ricochet off of the walls of the container.

In the game of Keno, players select numbers that may be drawn from the Keno display device. The display device jumbles or mixes numbered balls in the container and then draws a predetermined number of balls from the container. Players are paid based on the number of balls drawn from the display device that match the numbers they selected.

However, before the present invention, the Keno display device has been unsuitable for use with gaming devices. One of the reasons this is so is because Keno is susceptible to environmental influences. An important aspect of any gaming device is resistance to environmental influences that could affect the results of the game. However, as the balls are jumbled in the Keno ball device, static electricity, dust, and contaminants build up on the balls. This may cause the balls to stick to each other or to components in the display device thereby influencing the randomness of the game. Furthermore, the balls used in Keno displays may have slightly different weights or sizes that subtly affects the outcome of the game.

Another reason the game of Keno has been unsuitable as an indicator for a gaming device is that it requires a great deal of human involvement. In many Keno games, human operators are required to read the numbers of the Keno balls as they are selected and input the numbers into a computer or display. Furthermore, operators must regularly clean the Keno balls and the Keno devices to keep dust and contaminants from building up on the balls. Not only does this require far too much human involvement for an automated gaming device (the greater the human involvement, the greater the cost of operating the game), the game is also susceptible to tampering and cheating.

Because of its susceptibility to environmental influences and tampering and its dependence on human operators and maintenance personnel, Keno games are not allowed in at least one major gaming jurisdiction. Furthermore, these disadvantages have prevented Keno display devices and other devices that use jumbled balls from being adapted for use with gaming devices. What has long been needed is a means for adapting jumbled ball display devices for use with gaming devices. Although reference is made to the game of Keno, it is to be understood that the present invention may be used with almost any type of ball or jumbled ball display device, such as lottery balls.

Jumbled Ball Displays

Two references that have attempted to utilize jumbled ball displays are U.S. Pat. No. 4,871,171 issued to Rivero and U.S. Pat. No. 5,380,007 issued to Travis et al. Rivero appears to disclose a game device with means for simulating the release of a ball. In this reference, a rotating drum 2 is provided with numbered balls 17. As the drum rotates, a ball is released into a transparent tube 16.

However, Rivero is not intended to show the player the ball that is released from the drum. Rather, the ball is held in the tube, out of view of the player, and an electronic simulation of the ball number is presented in a window 9. This is intended to give the player "the impression" that the ball has been counted. Rivero fails to disclose or suggest displaying actual balls to the player to indicate the outcome of the game or the value of a prize.

Travis et al. appears to disclose a video lottery gaming device with numbered balls 48. However, all of the balls are simulations generated by software and no physical balls are displayed to the player. Travis et al. also fails to disclose or suggest displaying actual balls to the player to indicate the outcome of the game or the value of a prize.

One of the disadvantages with Rivero and Travis et al. is that no actual physical balls are used to display the outcome of a game. This is less desirable because players like to see physical objects rather than electronic simulations of the physical objects. Moreover, players tend to believe that a game device is misleading when the device purports to display a simulation of an object rather than the object itself. This is especially true when the object itself is supposedly available for viewing, as is the case in Rivero.

SUMMARY

Advantages

The various embodiments of the present invention may, but do not necessarily, achieve one or more of the following advantages:

One of the advantages of the present invention is that it provides a gaming device that utilizes a highly visible display device.

A further advantage of the present invention is that it provides a display device that may be used with a primary game or a bonus game.

Another advantage of the present invention is that it provides a display device that utilizes physical objects.

An additional advantage of the present invention is that it utilizes a jumbled ball display device that is similar to the well-known game of Keno and other games that utilize jumbled balls.

Another advantage of the present invention is that it provides a display device that eliminates environmental influences on the outcome of the game.

A further advantage of the present invention is that it provides a display device that reduces the risk of tampering.

Another advantage of the present invention is that it provides a display device that requires no human operators.

Yet another advantage of the present invention is that it provides a display device that requires little maintenance.

Another advantage of the present invention is that it provides an instant lottery game.

These and other advantages of the present invention may be realized by reference to other portions of the specification, claims, and abstract.

Brief Description

The present invention includes a gaming device, comprising a game apparatus being adapted to allow a player to play a game and a jumbled ball display device. The jumbled display device includes a plurality of display balls, at least one container adapted to hold the display balls, and at least one agitator adapted to agitate the display balls inside of the container. The container preferably includes at least one portion that is at least partially transparent, which allows the player to view the balls in the container. The jumbled ball display device preferably does not affect the outcome of the game played on the game apparatus. The gaming device further includes a prize display in communication with the game apparatus. The prize display is preferably adapted to select a prize ball to determine the outcome of the game and display the selected prize ball. The gaming device also preferably includes a media dispenser in communication with the game apparatus. The media dispenser is preferably configured to dispense media to the player.

The present invention also includes a method of playing a game with a player, comprising providing a jumbled ball display, providing a plurality of prize balls, selecting at least one prize ball to determine the outcome to the game, and providing a media to the player. The jumbled ball display preferably includes a container and a plurality of display balls in the container. The container preferably allows the player to see the display balls. The jumbling of the display balls in the container preferably has no effect on an outcome of the game. The media preferably notifies the player of the game outcome at least partially based on the selected prize ball.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Preferred embodiments of the present invention are shown in the accompanying drawings wherein.

DESCRIPTION OF THE PREFERRED EMBODIMENT

Figure 1A:
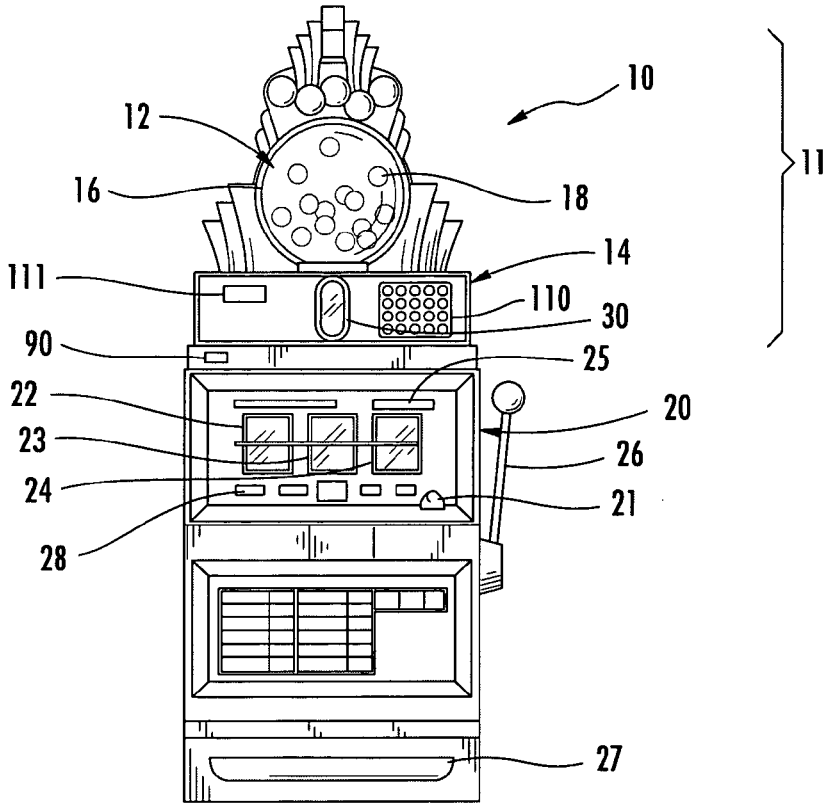
FIG. 1A is substantially a front view of the gaming device of the present invention.

As seen in FIG. 1A, the present invention comprises a gaming device, generally indicated by reference number 10. Gaming device 10 comprises a display device 11 and a game apparatus 20. Display device 11 may comprise a jumbled ball display 12 and a prize display 14.

Game Apparatus

With continuing reference to FIG. 1A, game apparatus 20 may be any of a large number of devices that are adapted to allow players to play a game. For example, game apparatus 20 may utilize spinning reels 22–24 or a video display (not shown) to display outcomes of the game. Means may also be provided for accepting wagers, such as a coin slot 21 or card reader 25, and for awarding prizes, such as a coin dispenser 27. A handle 26 and button 28 are provided for activating game apparatus 20 to begin a game. In at least one preferred embodiment, game apparatus 20 may be an S Plus model gaming device manufactured by International Game Technology in Reno, Nev.

Game apparatus 20 is preferably controlled by an electronic controller 82 (see FIG. 2) that utilizes a random number generator. The random number generator produces a random or pseudo random number for each game. The outcome of the game may be determined by comparing the random number to a table of outcomes stored in a memory and accessed by controller 82. A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes, and U.S. Pat. No. 5,456,465, issued to Durham. Controller 82 causes spinning reels 22–24 of the video display to show the outcome of the game that corresponds to the outcome of the random number generator. It is recognized that game apparatus 20 may operate in many other ways and still achieve the objects of the present invention.

Game apparatus 20 may also be capable of producing a bonus-activating event. This event may be many different types of events. For example, a bonus-activating event may comprise displaying a particular symbol, such as a "bonus" symbol, or combination of symbols, such as three "7" symbols, on reels 22–24. If the game being played is poker based, the bonus-activating event may be occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Jumbled Ball Display

With continuing reference to FIG. 1A, jumbled ball display 12 comprises a container 16 that is adapted to hold a plurality of display balls 18. Container 16 is at least partially transparent allowing players to view display balls 18 inside of the container. Container 16 is made of a transparent material, such as plastic or glass. In the preferred embodiment, container 16 is made of acrylic. Suitable containers of this type may be obtained from Tripp Plastics of Reno, Nev. However, container 16 may also be a wire cage of a type that is used in some Keno games.

Container 16 may have many different shapes, such as a sphere, cube, cylinder, triangle, etc. In the preferred embodiment, container 16 is substantially spherical with a partially flat back (not shown). The flat back allows container 16 to be large while still allowing gaming device 10 to placed against a wall, another gaming device, or other objects.

Although display balls 18 are preferably similar to Keno balls, many other types of balls may be used. For example, display balls 18 may be ping-pong balls or rubber balls. Display 12 also comprises, an agitator (not shown in FIG. 1) to agitate or jumble display balls 18 within container 16. The agitator may be a stream of air or a mechanical mixing device. The agitator causes the balls to bounce and ricochet off of the walls of container 16. In the preferred embodiment, a stream of air is used as an agitator and container 16 comprises an off center opening for the stream of air. The opening is off center to increase the initial agitation of display balls 18.

Fins (not shown) may also be provided at the bottom of container 16 to help agitate display balls 18. The fins support display balls 18 when they are resting at the bottom of container 16. This helps air circulate underneath display balls 18 to lift and separate the balls.

The purpose of jumbled ball display 12 is to attract and entertain players. When display balls 18 are agitated, they produce a vivid display that attracts the attention of people nearby and provides an exciting display for players playing gaming device 10. Display Balls 18 are preferably kept separate from balls used in display device 14.

Figure 1B:
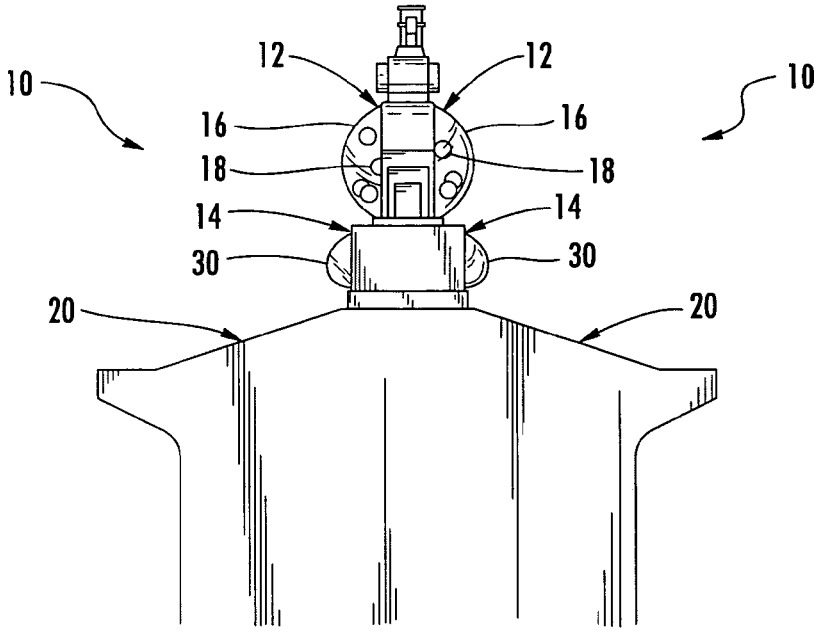
FIG. 1B is substantially a side view of an alternative embodiment of the gaming device of the present invention.

FIG. 1B represents an alternative embodiment of the present invention in which two gaming devices 10 are placed back to back. Each gaming device 10 comprises a game apparatus 20. Game apparatuses 20, shown in FIG. 1B is known as a "slant top" for their sloping upper surfaces. However, other types of gaming devices, such as the upright game apparatus 20 shown in FIG. 1A, may also be used.

In this embodiment, a separate jumbled ball display 12 is provided for each game apparatus 20. Each jumbled ball display 12 may comprise container 16 in the shape of a hemisphere. Containers 16 may be placed back to back so that the two containers have a spherical appearance when viewed from the side. Other shapes, such as cubes and cylinders, may also be used. A mirror may be placed at the back of each container 16 to enhance the appearance of the jumbled ball displays 12 by reflecting images of jumbled display balls 18 outward toward the players. Containers 16 may also be one single container that is divided in two by a mirror or other partition. Each container 16 has its own independently operated agitator and jumbled display balls 18. Each game apparatus 20 has its own independently operated prize display 14 with display window 30.

Prize Display

Referring to FIGS. 1A and 1B, prize display 14 is adapted to select a prize ball and display the ball to a player. When a bonus-activating event occurs, prize display 14 senses this, selects a prize ball, and displays the ball in a display window 30.

Turning now to FIG. 2, prize display 14 comprises a controller 76 that is adapted to control the operation of the device. Controller 76 may be one or more computers or processor boards. For example, in the presently implemented embodiment, controller 76 comprises a bonus controller and stepper motor controller, which may be manufactured by Progressive Solutions in Carmichael, Calif., a core module by Z-World in Davis, Calif., and a sound board by Cleverdevices in Syosset, N.Y. Other, equally suitable devices may be purchased from other manufacturers. It is recognized that controller 76 may be a single processor or processor board. Furthermore, it is also recognized that controller 76 and controller 82 may be combined in a single processor or processor board.

Controller 76 is adapted to detect when a bonus-activating event occurs in game apparatus 20. This may be accomplished by game apparatus controller 82 transmitting a signal to controller 76 that a bonus event has occurred. For example, controller 82 may determine the outcome of each game and when a bonus-activating outcome occurs, it transmits a signal to controller 76. Alternatively, controller 76 may periodically interrogate controller 82. In another embodiment, one or more sensors may be provided for determining if a bonus-activating event has occurred. For example, sensors 84–86 may sense the positions of reels 22–24. When reels 22–24 are in a bonus activating position, controller 76 would sense this position and begin a bonus sequence (described below). Sensors may also be provided external to gaming device 10 to detect external bonus-activating events.

Controller 82 may also transmit a variety of information to controller 76. For example, controller 82 may signal when coins or currency have been inserted, when a game starts, when an error has occurred, and when a sensor detects tampering.

When controller 76 detects a bonus-activating event, it may begin a bonus sequence by activating display 110. Display 110 may comprise many different kinds of display devices, such as video screens, lights, light emitting diodes, etc. Display 110 may comprise its own controller that is adapted to generate a variety of displays.

Display 110 may indicate that a player has qualified for a bonus round and prompt the player to perform an action. In the preferred embodiment, the player is prompted to activate the bonus sequence by pressing input device 90. Input device 90 may be a simple button, a keyboard, or a touch screen display. In the embodiment in which the player must accumulate a number of bonus symbols to qualify for a bonus, display 110 may indicate the number of symbols the player has received.

When controller 76 detects input device 90 being activated, the controller would activate the agitator in jumbled ball display 12. In the preferred embodiment, the agitator comprises blower 50, which blows air into container 16. Alternatively, the agitator may begin automatically and input device 90 may be used to initiate the display sequence. In another embodiment, controller 76 may wait a predetermined time period for the player to activate input device 90. If the player does not activate input device 90 in that time period, controller 76 would automatically activate the display 12 and initiate the display sequence. In yet another embodiment, controller 76 automatically initiates the display sequence in a predetermined time period, independent from input device 90, and input device 90 is only used to activate the jumbled ball display 12. Of course, no input device may be used and controller 76 may automatically activate display 12 and begin the display sequence.

To display a prize ball, controller 76 performs a routine to determine which ball will be displayed. This may be performed by a number of methods that are well known in the art. For example, prize balls 92 may be sequentially displayed or displayed based on external events, such as certain bonus activating events may always cause the same prize ball to be displayed.

In the preferred embodiment, however, prize balls 92 are randomly selected. Controller 76 generates a random number and then compares the random number to a pay table similar to that described for game apparatus 20 or as described in U.S. Pat. No. 5,823,874, issued to Adams. A simple pay table may appear as follows:

| Random Number | Prize Ball Number | Amount Paid |
|---|---|---|
| 0.00 to 0.50 | 1 | $1.00 |
| 0.51 to 0.75 | 2 | $5.00 |
| 0.76 to 0.95 | 3 | x2 |
| 0.96 to 1.00 | 4 | $1,000.00 |

For example, if the random number generator produced 0.65, prize ball number 2 would be displayed and $5.00 would be awarded to the player. If the random number generator produced 0.80, prize ball number 3 would be displayed. Prize ball number 3 is a multiplier ball that multiplies some amount produced by game apparatus 20. Gaming apparatus 20, for instance, may award $20 and the multiplier ball would multiply this by two, awarding the player $40.

The present invention is not limited to the example pay table shown. A greater number of prize balls may be used and, as will be discussed below, a combination of prize balls may be displayed. Furthermore, different kinds of prizes, besides monetary prizes, may be awarded. For example, the prizes may be goods, services, or additional games. The goods and services may be awarded in the form of physical objects, media, vouchers, coupons, etc. Additional games may be presented in the form of media, such as scratch off lottery media. In the embodiments in which media, vouchers, and coupons are used, the objects are dispensed using an internally or externally mounted dispenser 111. Such dispensers are well known in the art.

Once controller 76 determines the prize ball to be displayed and the prize to be awarded, the controller activates a positioning mechanism 77. Positioning mechanism 77 is adapted to position a selected prize ball (that is separate from display balls 18) so that it can be displayed. Positioning mechanism 77 may utilize a large variety of devices to achieve its purpose. In the preferred embodiment, all of the prize balls are held in a ball holder 58. Ball holder 58 may be made from a variety of materials, such as plastics, metals, or composites. In one embodiment, ball holder 58 is cast high-density urethane foam that is machined to obtain a precise shape. In the preferred embodiment, ball holder 58 is injection molded plastic.

Prize balls 92 preferably have a similar appearance to display balls 18 in container 16. This creates the illusion that balls displayed in display window 30 originate from container 16. At least one of prize balls 92 have a symbol that is capable of indicating a prize to be awarded to the player.

Prize balls 92 are stored in ball holder 58 in an individually controlled manner so that individual balls can be selectively removed from the ball holder. This allows particular balls with particular symbols or values to be individually manipulated and displayed when desired. This may be accomplished in different ways. In the preferred embodiment, ball holder 58 comprises a chamber 62 for each prize ball 92 stored in the holder. A display mechanism 29 is provided for removing ball 92 stored in chamber 62, displaying the ball, and replacing it in the chamber.

Figure 3:
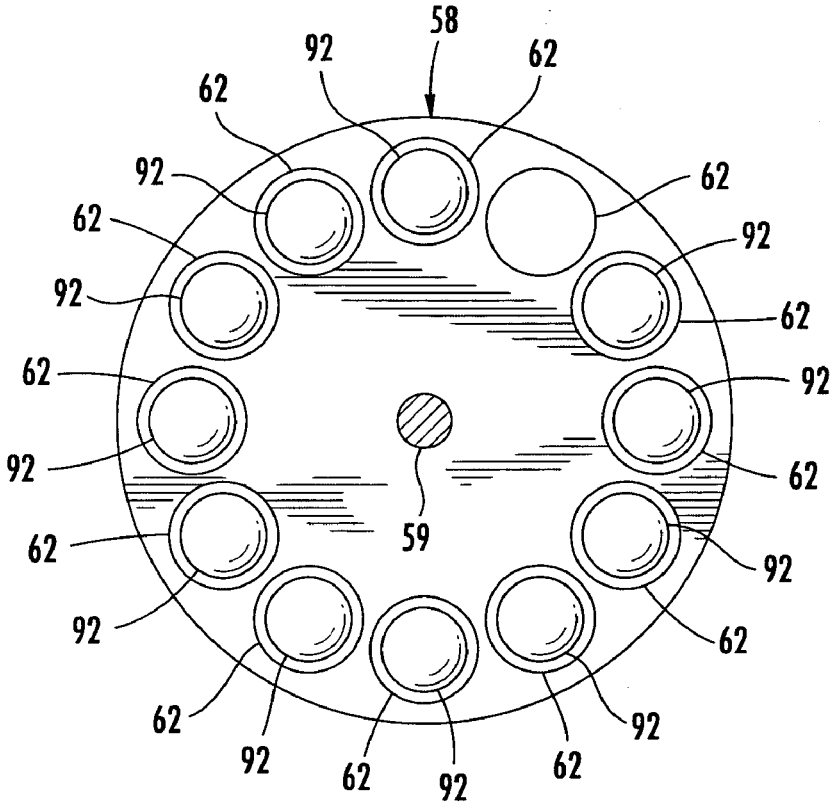
FIG. 3 is substantially a top cross sectional view of a preferred ball holder of the present invention taken along line III in FIG. 2.

In the preferred embodiment, ball holder 58 is cylindrical as illustrated in FIG. 3. Chambers 62 are positioned outward from a central axis 59 of ball holder 58, near the periphery of the holder. Thus, chambers 62 may be positioned by rotating ball holder 58 around its central axis 59.

Figure 4:
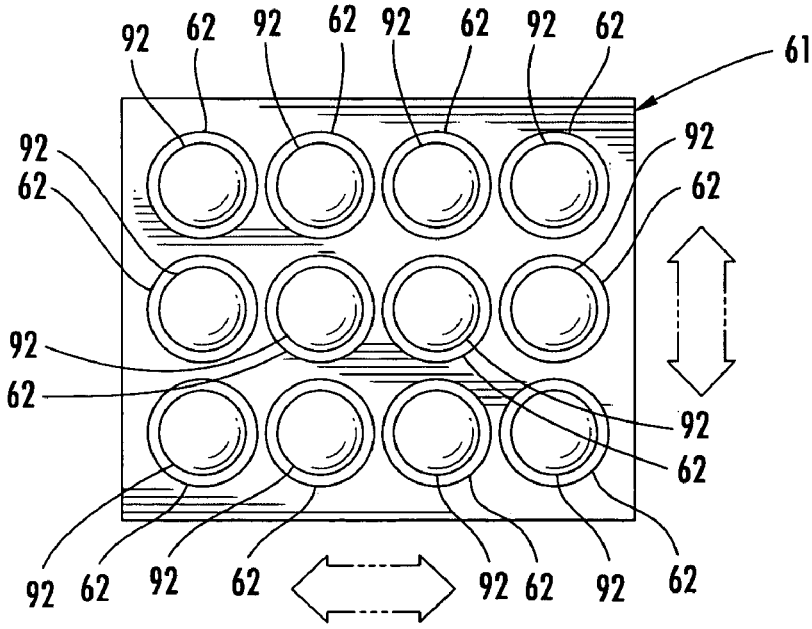
FIG. 4 is substantially a top cross sectional view of an alternative ball holder of the present invention.

Ball holder 58 may be provided in different configurations. For example, as shown in FIG. 4, ball holder 61 may be square or rectangular with chambers 62 arranged in rows and columns. In this embodiment, controller 76 is programmed with the location of chambers 62 and ball holder 61 is positioned by moving it laterally and longitudinally. Stepper motors and gears may perform the lateral and longitudinal positioning (not shown).

Returning to FIG. 2, positioning mechanism 77 comprises a stepper motor 60 for rotating holder 58. Wheel 74, rigidly attached to holder 58, and sensor 83, not attached to the holder, are provided for determining the angular position of the holder. Thus, controller 76 can position a ball 92 in holder 58 where it can be removed and replaced by rotating the holder and monitoring its angular position. The angular position of each prize ball 92 is stored in memory in controller 76. Sensor 83 may be an infrared source and detector and the periphery of wheel 74 may comprise portions with different reflective characteristics, such as physical holes or gaps or absorbent paint lines. Alternatively, an optical flag configuration similar to that described in U.S. Pat. No. 4,911,449, issued to Bertram, may be used.

Figure 2A:
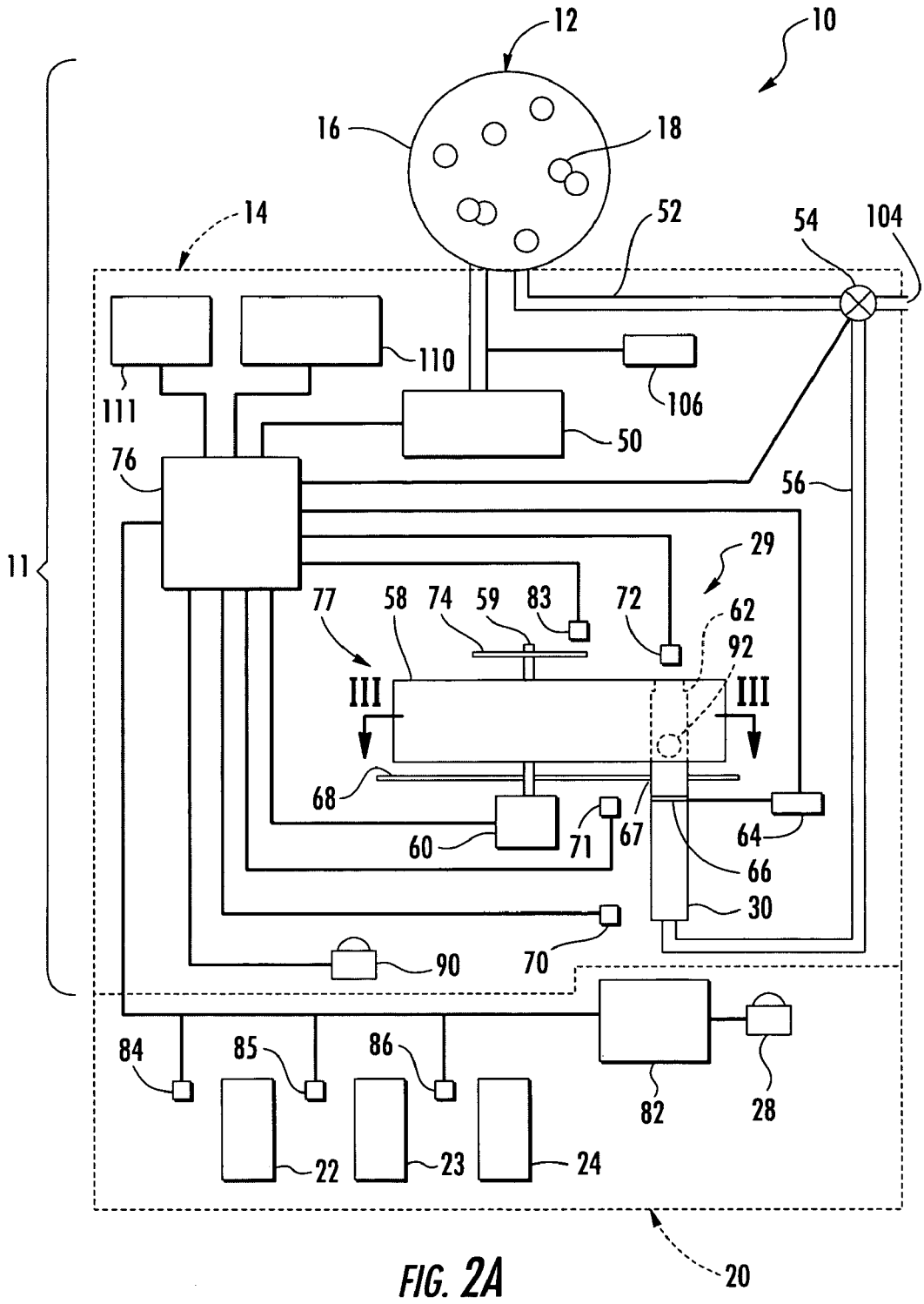
FIG. 2A is substantially a schematic diagram of an embodiment of the gaming device shown in FIG. 1A.
Figure 5A:
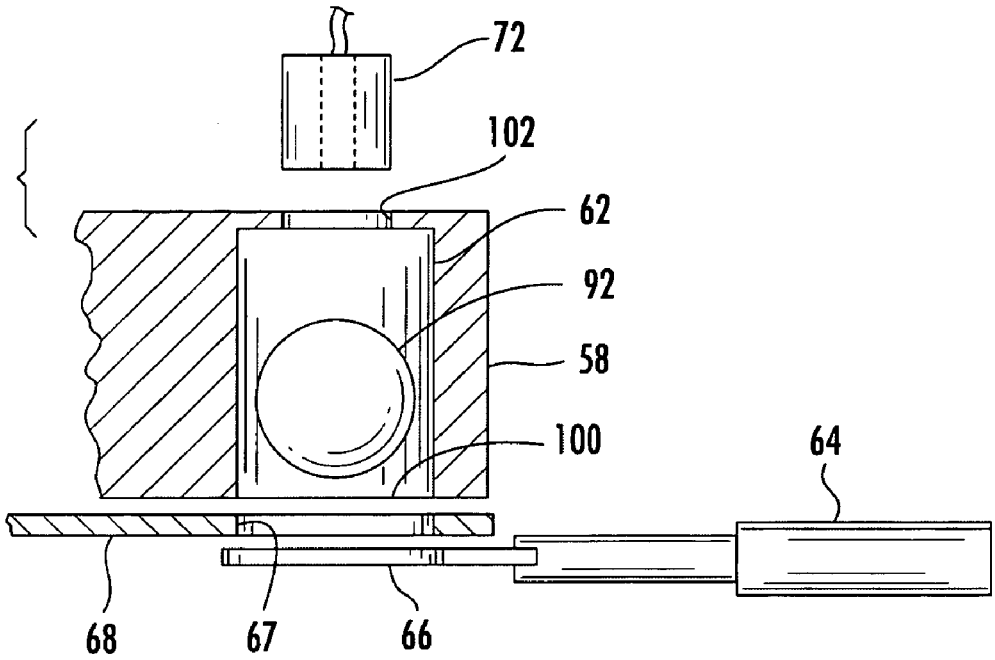
FIG. 5A is substantially an enlarged view of the ball holder shown in FIG. 2A.

In the preferred embodiment, holder 58 is arranged to allow the force of gravity to remove balls 92 from the holder. Referring now to FIGS. 2A and 5A, each chamber 62 has a lower opening 100 that is large enough for prize ball 92 to pass through. A plate 68 is provided on the lower surface of holder 58 for preventing prize balls 92 from falling out of chambers 62. A hole 67 is provided in one portion of plate 68 for allowing ball 92 to pass through the plate. A gate 66 blocks ball 92 until it is opened by an actuator 64. Gate 66 may cover the entire hole 67 or just a portion of it and it may be operated in a sliding or hinged manner. Actuator 64 may be an electrical solenoid actuator.

Figure 5B:
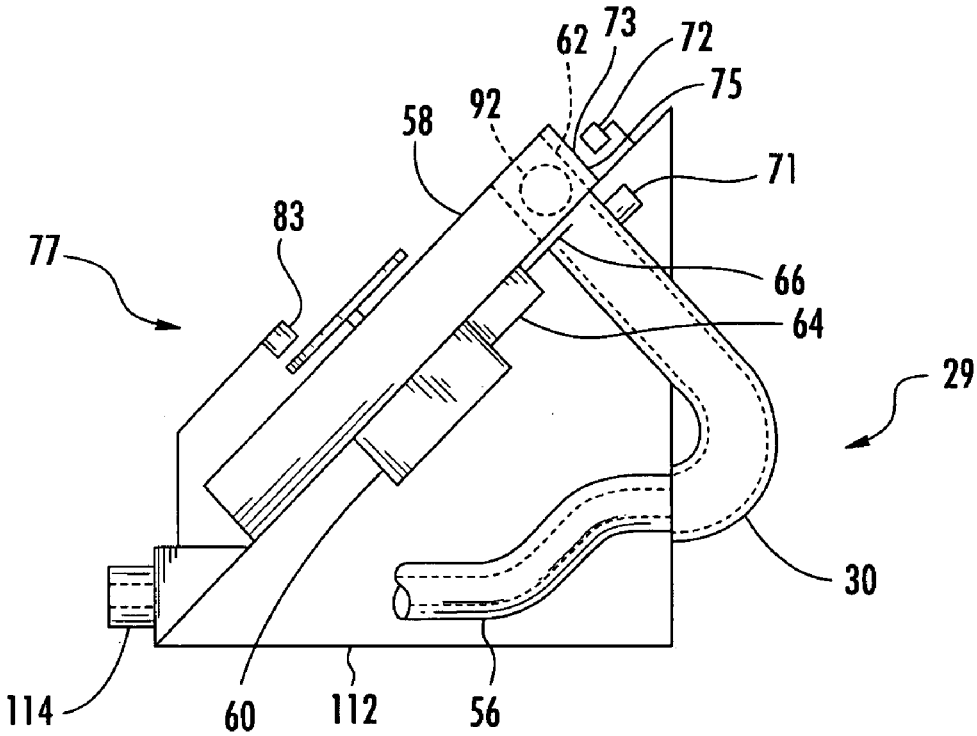
FIG. 5B is substantially a side elevational view of the positioning and display mechanisms of a preferred embodiment of the present invention.

FIG. 5B represents a preferred embodiment in which a chassis 112 supports ball holder 58 at approximately a forty-five degree angle to the vertical. Mounting grooves (not shown) may be provided in prize display 14 for slidably receiving chassis 112 and connector 114 may be provided for connecting electrical circuits and devices to power supplies and controller 76. One of the advantages of this embodiment is that positioning mechanism 77 and display mechanism 29 can be easily serviced by removing chassis 112 from prize display device 14.

Referring to FIGS. 2A and 5A, in normal operation, after controller 76 has determined which ball is to be displayed, the controller rotates holder 58 until the desired prize ball 92 is positioned over the plate hole 67. At the appropriate time, controller 76 activates actuator 64 to open gate 66. The force of gravity then pulls prize ball 92 downward through hole 67 into display window 30. Display window 30 may be a chamber with a transparent or partially transparent wall that allows the player to see selected prize ball 92. In the preferred embodiment, display window 30 comprises a tube that projects outward from the front surface of prize display device 14. This allows players to view prize ball 92 from many different angles and see symbols on the ball. Sensors 70 and/or 71 may be used to verify that prize ball 92 has fallen into display window 30. If sensors 70 and/or 71 do not detect ball 92 in its proper position, controller 76 may enter an error mode.

If the ball is detected in its proper position, controller 76 may cause display 110 to display the prize, if any, that the player has won. Other effects may also be presented, such as pre-recorded sound from speakers. If the actual prize is money, the amount of the prize may be added to the player's credit meter or the prize may be dispensed from dispenser 111 or coin dispenser 27.

After ball 92 has been displayed long enough, controller 76 operates a valve 54 to divert exhaust air from container 16. While blower 50 is in operation, air is allowed to escape container 16 through an exhaust duct 52. Valve 54 is used to divert air from a vent 104 to a display duct 56. Display duct 56 directs air to the bottom of display window 30 where it blows the ball 92 upwards back into chamber 62. An upper opening 102 is provided in chamber 62 for allowing air to escape from the chamber thereby producing an air current. Sensors 72 and/or 71 may be used to verify that ball 92 has returned to chamber 62. If the ball is not detected in its proper position, controller 76 may enter an error mode and an attendant is called. In the preferred embodiment, shown in FIG. 5B, sensor 72 is placed next to the peripheral wall 75 of ball holder 58 and a hole 73 is provided in the peripheral wall next to each chamber 62.

It is recognized that the components of the present invention may be arranged alternatively so that ball display window 30 is located above holder 58 and ball 92 is blown upwards into the display. When valve 54 is closed, the force of gravity pulls ball 92 back into chamber 62. In this alternate embodiment, once ball 92 has returned to chamber 62, controller 76 closes gate 66 by activating actuator 64, turns off blower 50, and waits for the next activating event.

A power failure or power surge could cause actuator 64 to malfunction and improperly open gate 66 while prize display 14 is idle. This would cause prize ball 92 to fall out of chamber 92 into display window 30, thereby giving a false indication that the player had won a prize. In order to prevent this, in the preferred embodiment, at least one chamber 62 does not have prize ball 92 (see FIG. 3). This empty chamber is positioned over hole 67 whenever prize display 14 is idle.

In certain embodiments, display balls 18 may be agitated by actuation of jumbled ball display 12. If display balls 18 are agitated by actuation of jumbled ball display 12, it may be desirable to employ other methods of actuating and displaying prize balls 92. For example, if an air compressor is not needed for agitation of display balls 18, it may be beneficial to modify the method of displaying prize balls 92 so that the air compressor may be eliminated from game apparatus 20.

Figure 2B:
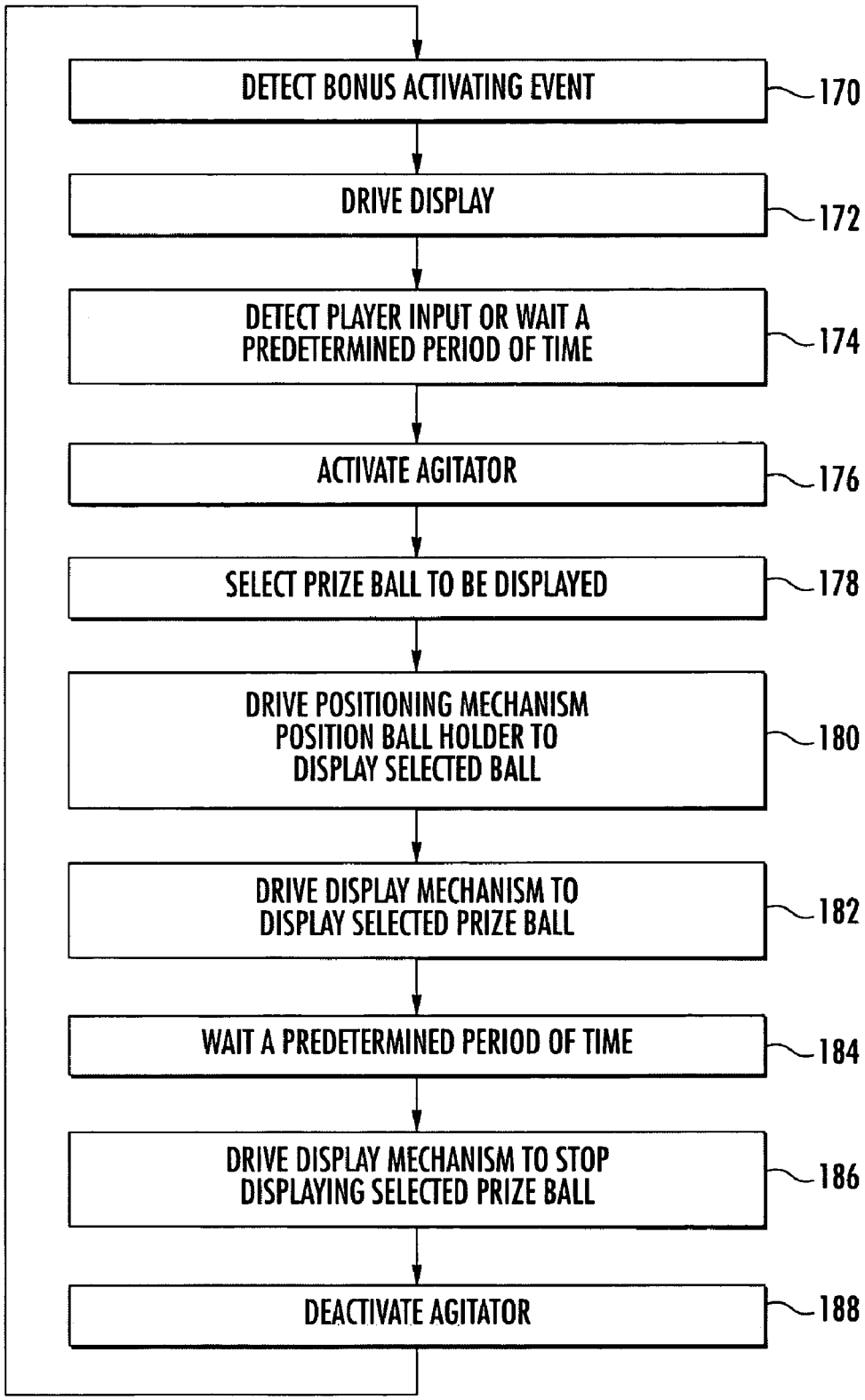
FIG. 2B is substantially a flow chart of the operation of the display device of the present invention.
Figure 2C:
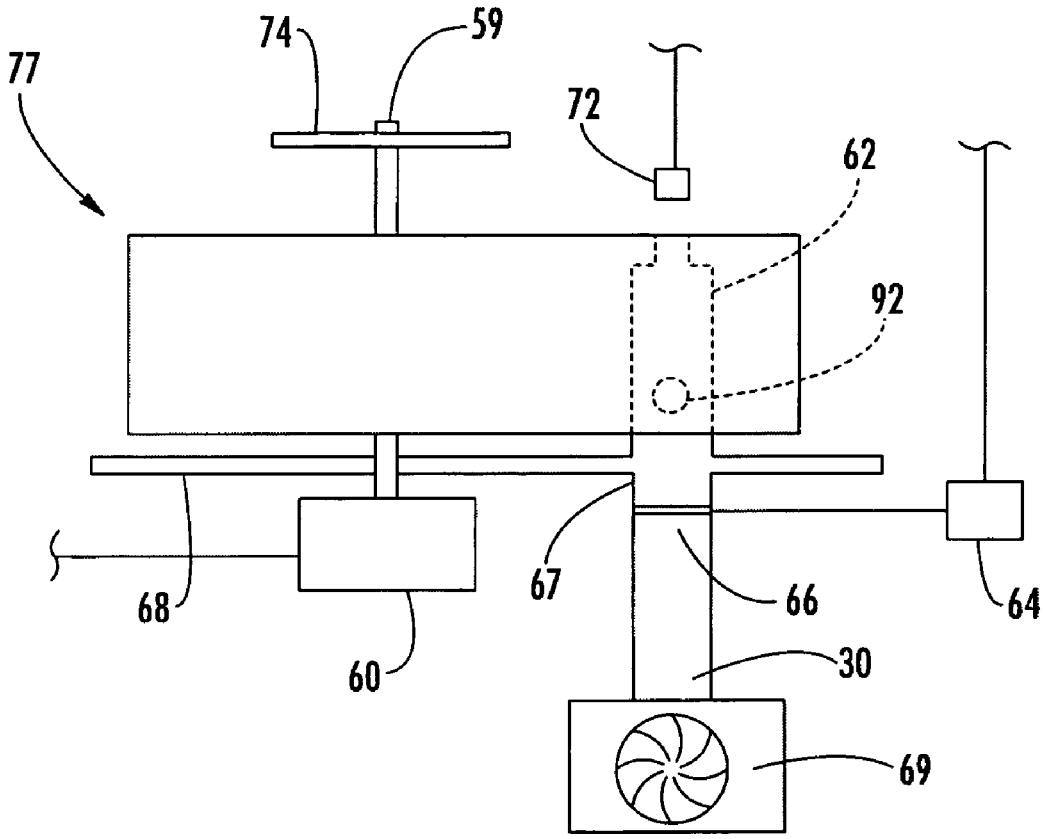
FIG. 2C is substantially a schematic diagram of an alternate prize ball display mechanism for use in the gaming device of FIG. 2A.

For example, as illustrated in FIG. 2C, rather than opening valve 54 to divert air to display duct 56 (as in FIG. 2A), an air source or blower can be located below display window 30. For example, a fan 69 may be placed below display window 30. When activated by controller 76, fan 69 operates and creates a stream of air that blows display ball 92 in display window 30 back into chamber 62. Although many fans can be used, one suitable fan is DC brushless fan motor model number BG0703-B044-000 available from Minebea Co., Ltd. of Tokyo, Japan. Of course, other air sources besides fans may be used without departing from the scope of the present invention.

Because some balls are very light, static electricity can cause the balls to stick to each other and to other components. To prevent this, a variety of static discharge devices 106 may be placed in various locations in the present invention. In the preferred embodiment, static discharge device 106 is a bare stranded copper wire with its strands spread out. The wire is placed in the flow of air between agitator 50 and container 16 and wire is attached to a common ground.

Prize display 14 of the present invention may also comprise means for simultaneously displaying a plurality of balls 92. To accomplish this, plate 68 may have multiple holes 67 (not shown), each with its own gate 66 and actuator 64, for supplying balls to multiple display windows. Thus, holder 58 may be positioned so that the appropriate ball is positioned over the appropriate hole 67 for supplying the appropriate display window 30. Alternatively, a plurality of ball holders 58 may be provided, each one supplying balls to a separate display window 30.

Figure 6:
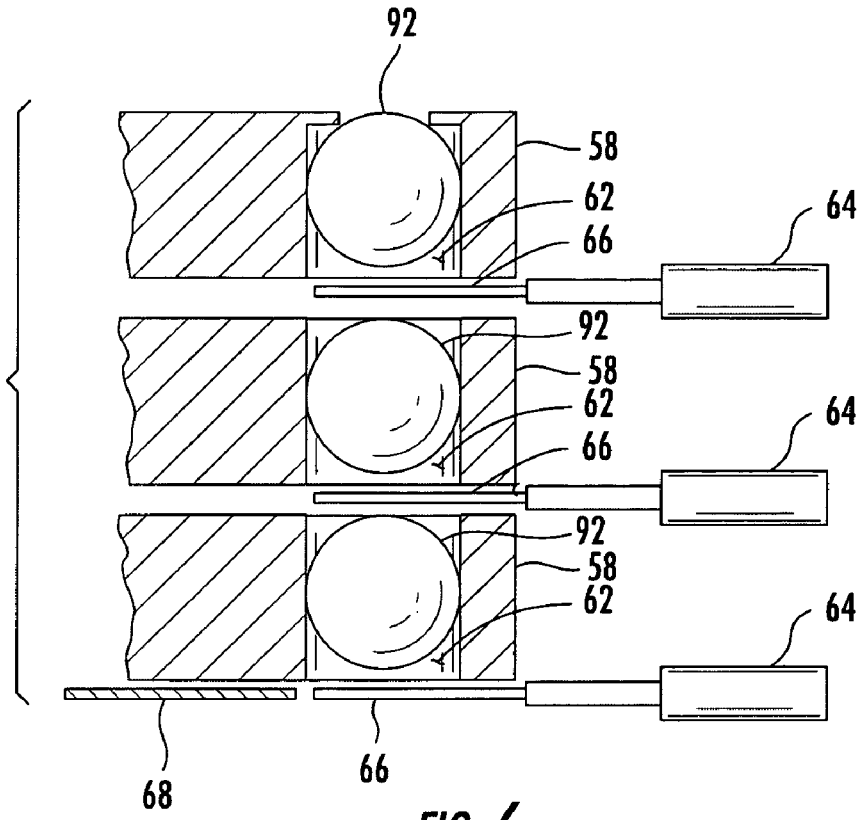
FIG. 6 is substantially a schematic diagram of an alternative embodiment of the present invention using multiple stacked ball holders.

In yet another embodiment, seen in FIG. 6, a plurality of separately controlled ball holders 58 are arranged in a stack. Each ball holder 58 is rotated to a position so that chambers 62 are aligned above display window 30. Gates 66 are then opened and balls 92 are allowed to fall into display window 30. In this embodiment, display window 30 is large enough to display three balls simultaneously. When the display period has ended, balls 92 are blown back into chambers 62 and gates 66 are closed to separate and contain the balls. The action of gates 66 separates prize balls 92 into separate chambers 62.

With multiple balls being displayed, it is possible to use combinations of balls to indicate various bonus outcomes. It is also possible to replace the primary display of a gaming device with selector and prize display device 14. In other words, game apparatus 20 may be entirely replaced with selector and prize display device 14.

Figure 7:
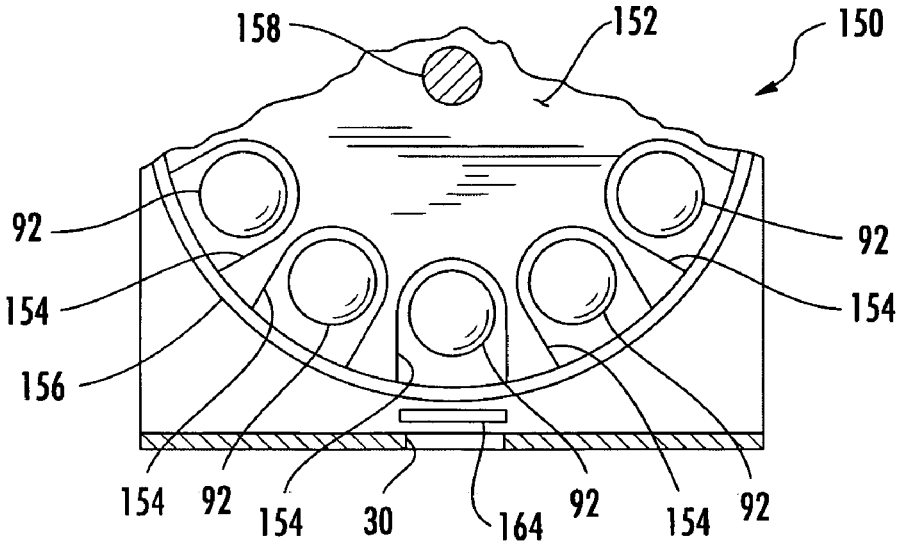
FIG. 7 is substantially an alternative display mechanism of the present invention.

As seen in FIG. 7, the present invention comprises an alternative display mechanism 150. Display mechanism 150 comprises a cylindrical ball holder 152 that may be rotated around its central axis 158. Ball holder 152 comprises a plurality of chambers 154 positioned along the periphery of the holder, each chamber is adapted to hold ball 92. Unlike the embodiment described in FIGS. 2, it is not necessary to remove and replace balls 92 from chambers 154. Instead, at least a portion of the outer wall of each chamber 154 comprises a transparent material that allows players to view balls 92 inside the chamber. The transparent wall may comprise a ring of transparent material 156 that surrounds holder 152. A shutter device or door 164 may be provided between display window 30 and holder 152 for blocking the view of players while the holder is rotated. Although this embodiment has the advantage of a simpler mechanism, it may be less entertaining to players because it may be more apparent to the players that balls 92 do not originate from jumbled ball display 12.

Figure 1C:
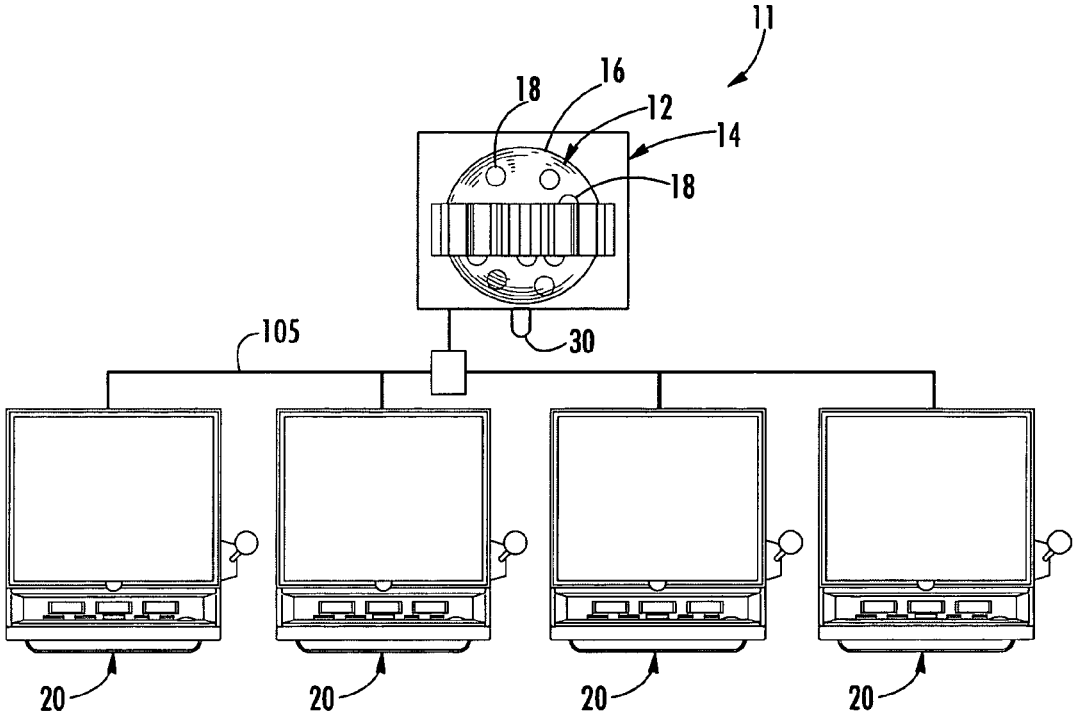
FIG. 1C is substantially a top schematic diagram of the display device of the present invention in use with a plurality of gaming apparatus.

As seen in FIG. 1C, a single display device 11 may also be used with a plurality of game apparatus 20. In this embodiment, each game apparatus is in communication with display device 11 by a communication device 105. Communication device 105 may be a network cable, such as an Ethernet cable, and appropriate hardware, such as network interface cards, may be included in display device 11 and game apparatus 20. When one of the game apparatus 20 produces a bonus-activating event, a signal is sent to display device 11. A prize ball may then be selected and displayed as described above.

Turning now to FIG. 2B, the operation of prize display 14 begins when controller 76 detects a bonus-activating event 170. Controller 76 may then drive display 110 to display an appropriate presentation or message 172. As discussed above, controller 76 may wait for player input from input device 90 or it may wait for a predetermined period of time 174. At some point, controller 76 activates the agitator 176 and selects a prize ball to be displayed 178 from ball holder 58. Controller 76 then drives positioning mechanism 77 to position ball holder 58 so that the selected prize ball may be displayed 180 and causes display mechanism 29 to display the selected ball 182. Controller 76 may then wait a predetermined period of time so that the player may see the displayed prize ball 184, after which it causes display mechanism 29 to stop displaying the selected prize ball 186. The agitator is then deactivated 188 and controller 76 returns to a monitoring state to detect the next bonus activating event 170.

Bingo

Figure 8:
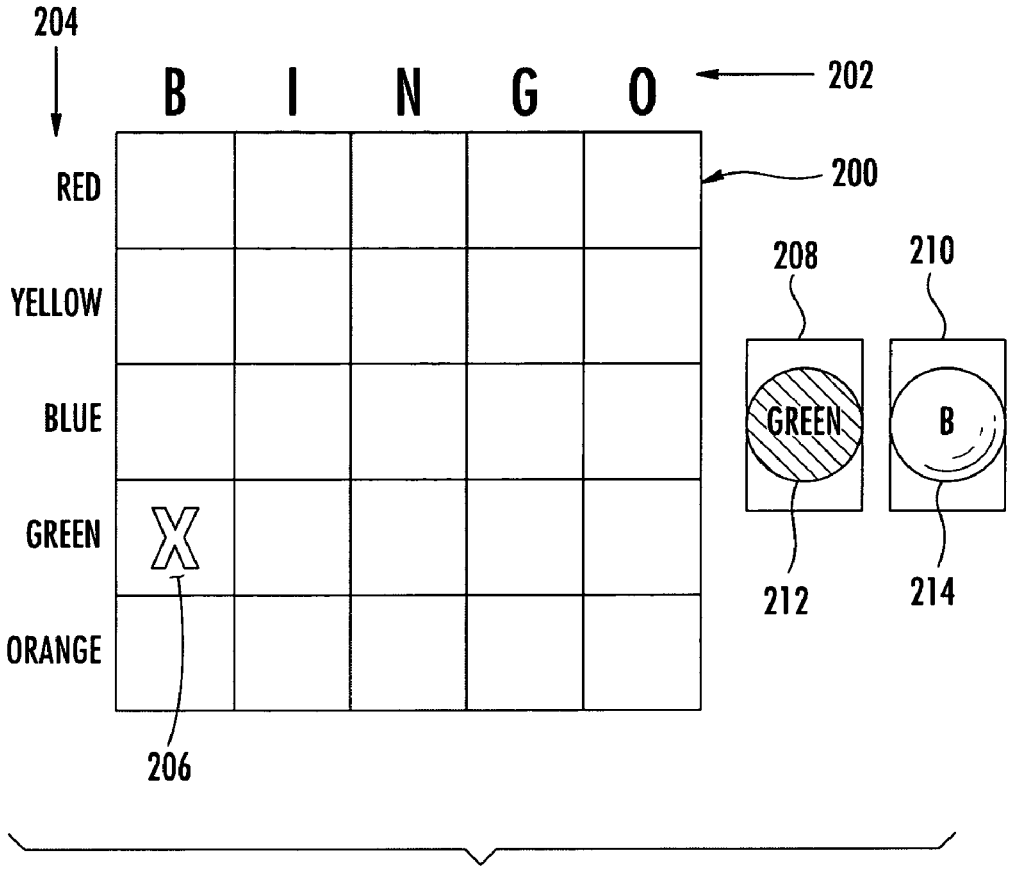
FIG. 8 is substantially a schematic representation of a bingo game that may be used with the present invention.

A number of games have been developed to take advantage of the unique features of the present invention. As seen in FIG. 8, one of the games of the present invention comprises a bingo card 200 that may be displayed by a display device, such as an LCD, LED, CRT, or backlit translucent material. The horizontal axis of the card may comprise alphabetic or numeric characters 202 and the vertical axis of the card may comprise colors 204. The alphanumeric characters and the colors may be randomly arranged for each new game, thereby adding variety to the game.

In the Bingo embodiment, prize display 14 comprises two display windows 208 and 210. Each display window 208 and 210 may have its own individual ball holder 58 and prize balls 92 (not shown in FIG. 8). Ball display 208 corresponds to the vertical axis with balls 212 therein displaying colors and ball display 210 corresponds to the horizontal axis with balls therein displaying alphabetic or numeric characters.

In this game, the player wins a bonus prize by filling all of the spaces in a row, column, diagonal line, or combination of rows, columns, and diagonal lines with a symbol. For example, when the player qualifies for a bonus award, prize display 14 may randomly select and display a green ball 212 and a ball 214 with the letter "B" on it. A symbol 206 may then be displayed in the space where the "B" column and the green row intersect. Play would continue in this way until the player wins a prize. Once a prize is won, card 200 may be cleared so that the bonus game may be replayed.

Figure 9:
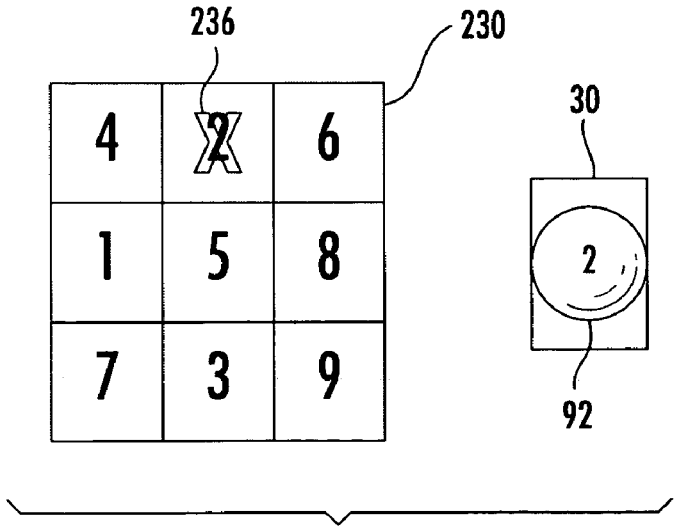
FIG. 9 is substantially a schematic representation of an alternative bingo game that may be used with the present invention.

An alternative embodiment of the Bingo bonus game is disclosed in FIG. 9. In this embodiment, a bingo card 230 displays a plurality of symbols. The symbols may be randomly arranged on card 230 for each game. When display window 30 displays a ball 92, displaying a symbol thereon, a symbol 236, such as an "X," is placed on the corresponding space on bingo card 230.

Figure 10:
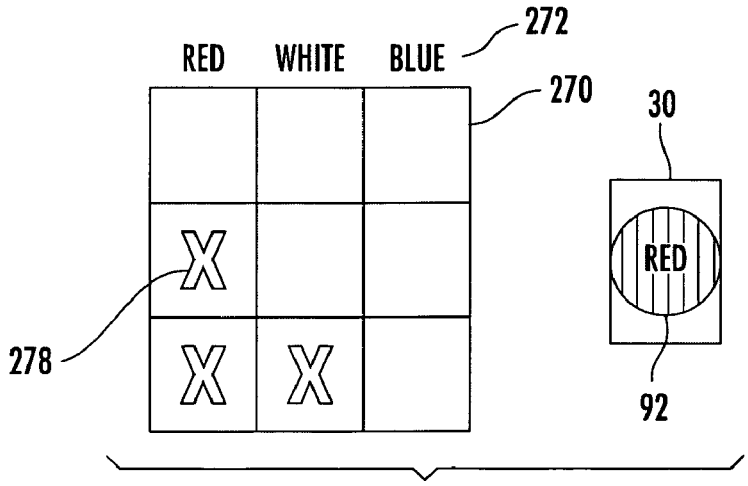
FIG. 10 is substantially a schematic representation of an alternative bingo game that may be used with the present invention.

In another embodiment, shown in FIG. 10, card 270 is divided into a plurality of columns. Each column corresponds with a particular type of symbol or color. The columns preferably have labels 272 on a horizontal axis. As prize display 14 displays a ball 92 in display window 30, a symbol 278 is placed in a space in the column that corresponds to the symbol on the ball. In this embodiment, the player is awarded a prize when all of the spaces in at least one column are filled. Card 270 is then cleared so that play can repeat.

Of course, many different variations of the Bingo bonus game may be utilized with the present invention. For example, larger or smaller cards and different symbols or combination of symbols may be used with the invention.

Lottery

Figure 11:
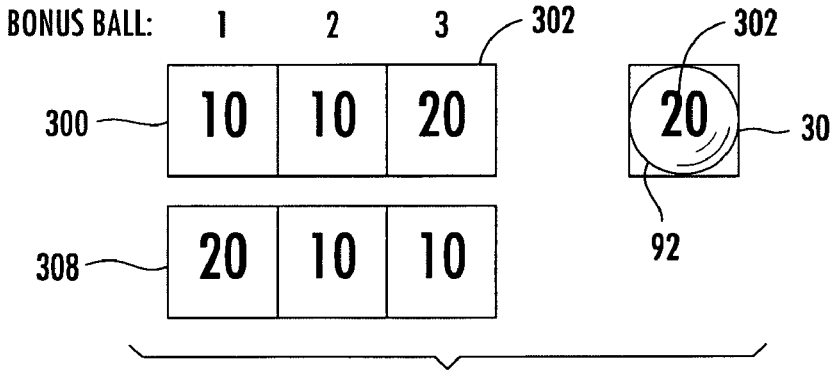
FIG. 11 is substantially a schematic representation of a lottery style game that may be used with the present invention.

The present invention also includes a game that follows a format similar to a lottery game. In this embodiment, seen in FIG. 11, prize ball 92 is selected and displayed in display window 30 in the same manner as other embodiments discussed above. Each time a ball is selected, a symbol 302 on the prize ball 92 is recorded in a first symbol display 300. In the example shown in FIG. 11, the number "10" has been recorded in the first and second areas for balls that have been previously selected and the number "20" is displayed in the third area for the most recent ball 92 selected. A second symbol display 308 is provided for displaying a randomly selected set of numbers. The numbers displayed in second display 308 may be generated with a random number generator that is adapted to select only the numbers that may be displayed on prize balls 92. Alternatively, similar to well known lottery games, the player may be allowed to pick the numbers in display 308. Of course, a greater or lesser number of spaces may be provided in displays 300 and 308.

In the preferred embodiment, the player is paid the amount shown on each prize ball 92 as it is displayed. Thus, in the example in FIG. 11, the player would be paid 20 credits or dollars for number 302 that is presented on the currently displayed ball 92. In addition to the prize displayed on ball 92, the player may qualify for an additional amount if the symbols displayed in first symbol display 300 are the same as the symbols displayed in second symbol display 308. In one embodiment, the symbols in first symbol display 300 must be in the same order as the symbols displayed in second symbol display 308. Thus, in the example shown in FIG. 11 the player would not win a prize because the order of the numbers are not the same. In another embodiment, the order of the numbers is irrelevant. Thus, in the example shown in FIG. 11 the player would win a prize because the symbols in first symbol display 300 are the same as the symbols in second symbol display 308. A modified version of the second embodiment would award a larger prize to the player if the order of the numbers in the two displays 300 and 308 were the same. In yet another embodiment, the prize that is awarded to a player is a progressive jackpot of a type that is well known in the art.

Player Selection

Figure 12:
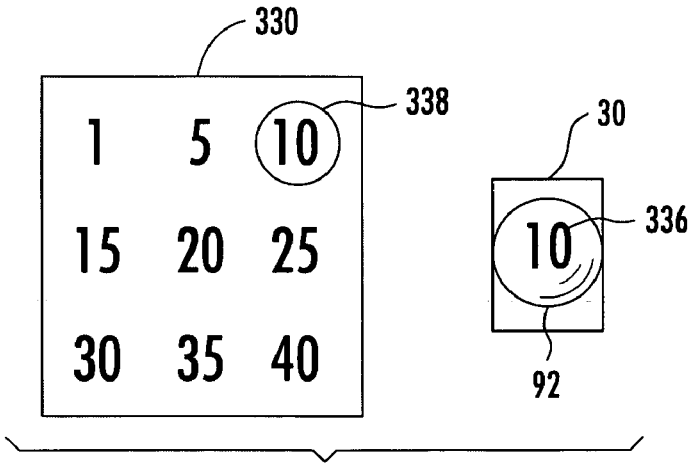
FIG. 12 is substantially a schematic representation of a player selection game that may be used with the present invention.

In another game of the present invention, the player selects a symbol or symbols from a list of symbols that the player may receive. Illustrated in FIG. 12, a display device 330 may be provided that displays a plurality of different symbols. When the game begins, the player may be prompted to select one of the possible symbols. In the case of a touch screen, the player may select the symbol by pressing the symbol with the player's finger. Other selection devices, such as buttons, may also be used. A graphical indicator may be used to indicate that the symbol has been selected, such as a circle 338 around the symbol. Once the symbol has been selected, the prize display 14 selects a prize ball and displays it in display window 30. If a symbol 336 on ball 92 matches the symbol selected by the player, the player is awarded a prize. In an alternative embodiment, the player is awarded the prize shown on the ball and the player receives an additional prize if the symbol on the ball matches the symbol selected by the player.

The player selection embodiment of the present invention may be combined with the lottery embodiment of the present invention. In this combination, the player is asked to select a plurality of numbers. If the symbols on the balls selected by prize display 14 are the same as the symbols selected by the player, the player is awarded a prize.

One of the advantages of providing the games discussed above is to increase the excitement and enjoyment of playing gaming device 10. Not only are the games entertaining to view, but they also increase the excitement and enjoyment experienced by players by offering large prizes. Each of the games can be adapted to award large prizes because they are capable of producing low probability events from which the large prizes are awarded.

In addition, the games of the present invention may be adapted for use as the primary game. Thus, game apparatus 20 may be completely replaced with the games of the present invention.

Video Display Embodiment

Figure 13:
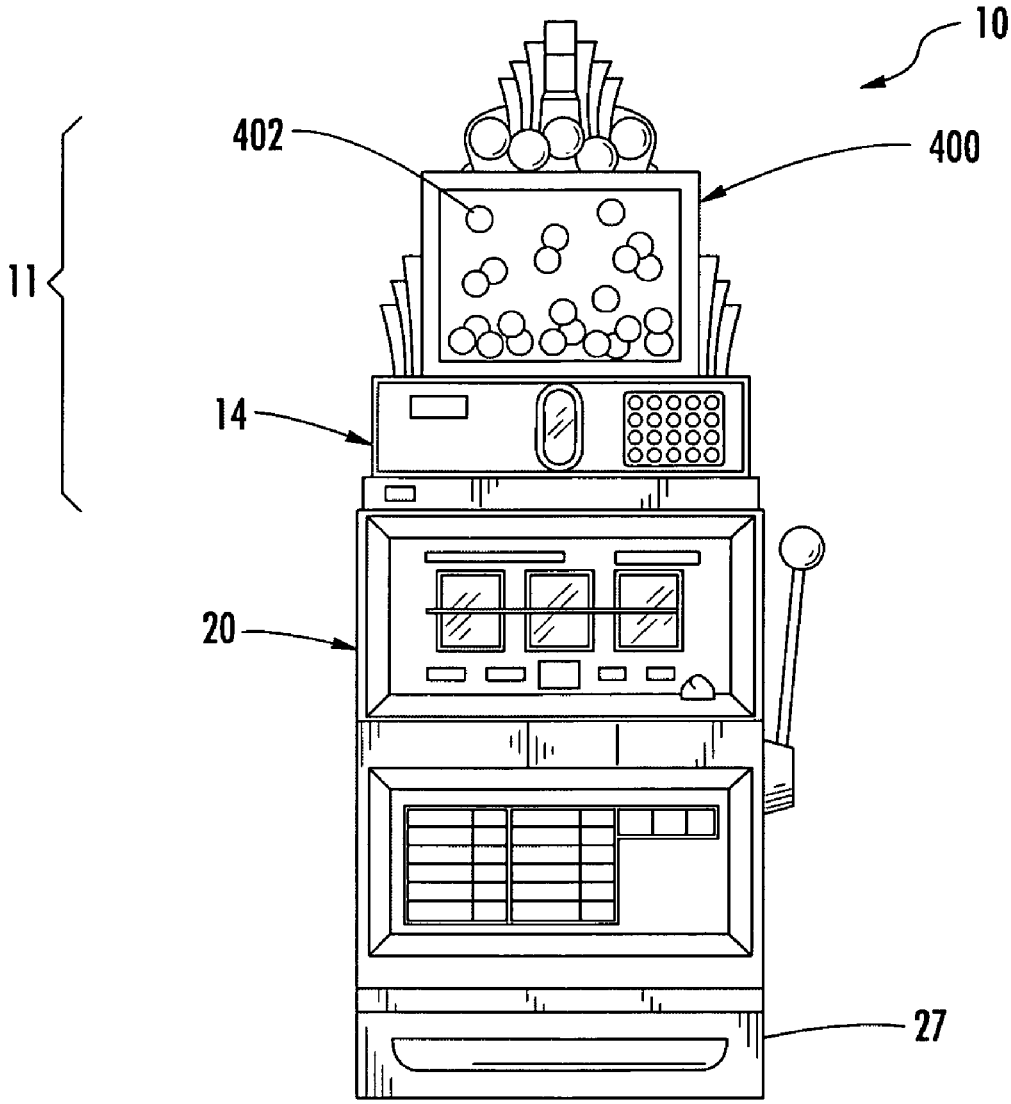
FIG. 13 is substantially a front view of the gaming device of the present invention utilizing a video display device.

As seen in FIG. 13, the present invention comprises an alternative embodiment that utilizes a video display device. In this embodiment, jumbled ball display 12 (see FIG. 1) is replaced by video display device 400. Video display device 400 presents an image of display balls 402 that is shown to the player. Video display device 400 may be any of a large number of display devices that are well known in the art. For example, video display device 400 may be a cathode ray tube of a type that is used with many personal computers.

Video display device 400 is in communication with controller 76 (see FIG. 2A). Controller 76 transmits messages to video display device 400 to request the display device to produce different displays. For example, controller 76 may send a signal to video display device 400 when a bonus-activating event has occurred to show balls 402 in an agitated state. After a bonus ball is selected and displayed, controller 76 may send another signal to video display device 400 to show the balls returning to a resting state.

Video display device 400 may comprise a video controller (not shown) that drives the display device to present various displays. Many different well-known video controllers may be used. Software and data used to produce different presentations may be stored on the video controller in non-volatile memory, such as compact disks, magnetic disk drives, or erasable programmable read only memory (EPROM).

Of course, video display device 400 may display other information in graphic and text form, such as instructions on how to use gaming device 10. Speakers may also be provided for presenting audio information, such as the sound of agitated balls or music when a prize is won.

This embodiment has the advantage of reducing maintenance because the moving parts of the jumbled ball display are eliminated. This embodiment also provides greater flexibility because many different kinds of presentations may be displayed on the video display device 400.

Gaming device 10 disclosed in FIG. 13 utilizes video display device 400 in place of jumbled ball display 12, but prize display 14 is provided to select and display physical prize balls, which may be adapted to appear to originate from the video display device. However, it is recognized that video display device 400 may be used in place of prize display 14 as well. In this embodiment, video display device 400 could display a prize ball that appears to be randomly selected from the agitated display balls.

Media Dispenser

Figure 14:
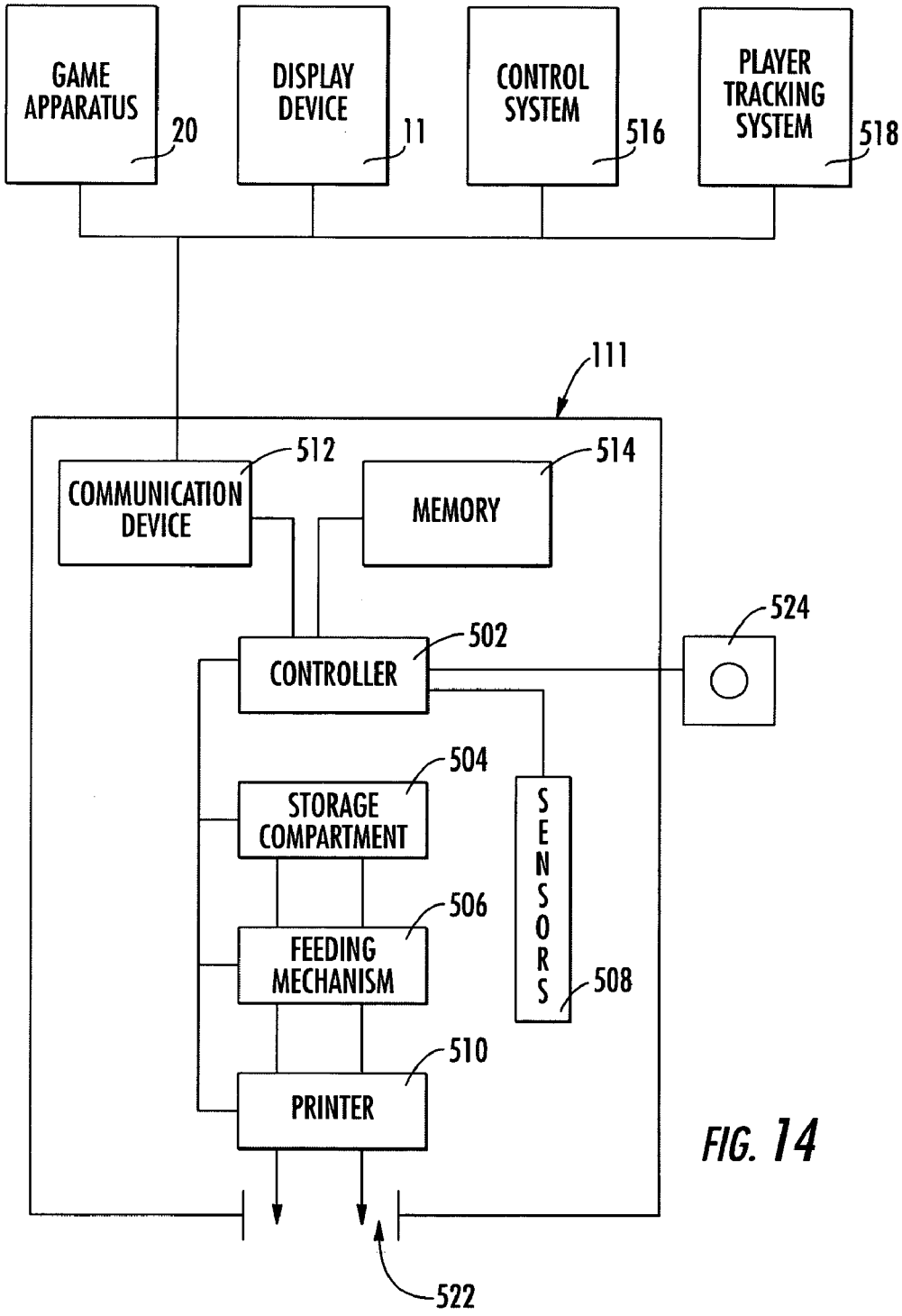
FIG. 14 is substantially a schematic diagram of another embodiment of the present invention capable of dispensing at least one media.

As seen in FIG. 1A, the present invention also comprises an embodiment that utilizes a media dispenser 111 that is capable of dispensing media, such as game media to players. Media dispenser 111 may be any of a large number of devices that are well known in the art and may dispense a variety of forms of media known in the art, such as vouchers, coupons, cards, etc. As seen in FIG. 14, media dispenser 111 may include controller 502 that is configured to control the operation of the dispenser. Controller 502 may be in the form of one of the many different types of microprocessors that are well known in the art. Controller 502 may be in communication with storage compartment 504, feeding mechanism 506, and printer 510. Storage compartment 504 may be configured to hold either preprinted media or media stock upon which information is printed. Alternatively, two or more storage compartments (not shown) may be utilized: one for media stock and one for preprinted media. Information on the media may be preprinted (that is, before game play and before introduction into the gaming device). Alternatively, information may be printed on the media as the media are being dispensed. This may allow the media to be personalized for the player and provide additional security against counterfeit media.

Feeding mechanism 506 may be provided to remove the media stock or preprinted media from storage compartment 504 and either advance the media through printer 510 and opening 522 or, in the case of preprinted media, to advance the media directly through opening 522.

Controller 502 may also be in communication with sensors 508, memory 514, and communication device 512. Sensors 508 are preferably configured to provide information to controller 502 regarding the status of printer 510. For example, a sensor may inform controller 502 how many media remain in storage compartment 504, when media dispenser 111 is accessed for servicing, or when feeding mechanism 506 malfunctions. Controller 502 may use this information to cease operation, request service, or transmit security information.

Memory 514 is configured to store software and data for operating media dispenser 111. Memory 514 may comprise various volatile and non-volatile memory devices that are well known in the art.

Communication device 512 is configured to allow media dispenser 111 to communicate with other devices. Communication device 512 may be in form of many well-known devices, such as a modem, a network interface device, or a wireless communication device. A communication line 520 may be connected to gaming apparatus 20, display device 11, central system 516, and player tracking system 518. Gaming apparatus 20 may be the gaming apparatus in which media dispenser 111 is installed or it may be another gaming apparatus remote from media dispenser 111. Similarly, display device 11 may be attached to the gaming apparatus in which media dispenser 111 is installed, or it may be physically separated. If media dispenser 111 is incorporated in a gaming device 10 (see FIG. 3), it may communicate directly with the controller of the gaming apparatus 20, the controller of display device 14, or both. Communication may be facilitated by standard computer communication devices, such as data ports and cables or computer buses.

A camera 524 maybe provided for capturing image data. Camera 524 may be any of a number of digital or analog cameras that are well known in the art. Camera 524 may be linked directly to controller 502 or a separate controller and memory device may be provided for processing the image data. As will be discussed below, image data captured by camera 524 may be used with the media of the present invention.

Media dispenser 111 may dispense a large variety of media. The media may be preprinted, they may be printed by media dispenser 111, or may be a combination of preprinted and printed. The following are examples of different kinds of media that may be dispensed:

- The media may be an advertisement for goods or services. For example, the media may advertise a casino restaurant or an upcoming concert.
- The media may be a coupon. For example, the media may allow a player to receive a discount on a good or service.
- The media may allow a player to participate in another game. For example, the media may be a lottery or raffle media that includes a media number. If the player's media number is drawn during the lottery or raffle, the player would win a prize. The media may allow a player to participate in a contest or competition, such as a slot tournament.
- The media may award a prize. For example, the player may redeem the media at a cashier's booth for cash or other prizes. This may be particularly useful when the prize has a high value or is a good that is not usually kept near the gaming device. In another embodiment, the player may also be allowed to redeem the award by inserting the media into the media dispenser. The media dispenser may comprise optical readers (not shown) in communication with the controller and the memory, which may cause the game apparatus to dispense the award upon confirmation.
- The media may be dispensed with at least one indicia. The media is preferably in communication with gaming apparatus 20. In this embodiment, the media may determine the game outcome, and therefore what prize balls are display to the player, rather than gaming apparatus 20, controller 502, controller 82, controller 76, or a random number generator. For example, the media could be similar to "quick pick" lottery tickets. The indicia displayed to the customer may communicate to game apparatus 20 what prize balls to display. The media dispenser may include optical readers (not shown) that are in communication with the controller and the memory for reading the dispensed media and determining what prize balls to display.

The media may have a credit value for play at another gaming device. For example, the player may take the media to another device with a media reader. Once the media is read, the player may be given a number of game play credits to play the device. This may be a useful way for casinos to introduce players to new gaming devices.

The media may be a scratch-off type media. This media comprises symbols that are hidden by removable material. Once the player removes the material, the symbols indicate whether the player has won a prize.

The media may have a partial game outcome that can be combined with the outcome of the gaming device. For example, the media may have a cherry symbol printed on it. When the game apparatus 20 generates an outcome of three cherries, the player can enter the media in a media reader and the player would be given a higher award because the player now has four cherries.

The media may have a "wild card" symbol that allows the player to replace a symbol with a more desirable symbol. For example, if a player received two cherry symbols and a grape symbol, the player may be able to enter the media in a media reader and the gaming device may replace the grape symbol with a cherry symbol, thereby allowing the player to qualify for a prize.

Graphical information may be printed on the media. For example, a digital camera 522 (see FIG. 14) may be provided in or near gaming device 10 for capturing image data when the player wins a prize. The player's picture may be printed on the media as a memento for the player. The symbols displayed and the prize the player won may also be printed on the media.

The media may be printed with personal information. For example, player-tracking system 518 (see FIG. 14) may cause a media to issue that tells the player that a table is ready for them at a nearby restaurant or that a friend is looking for them.

The media may have a cumulative value. For example, if a player accumulates a predetermined number of media, the player would qualify for a prize or to enter another game. This would encourage a player to player longer in order to accumulate the additional media.

The media may have symbols on them that would allow the player to play anther game. For example, each media may have a playing card printed on the media. The player could then collect the media to make a poker hand. Once the player had accumulated a poker hand, e.g., a flush or straight, the player may be awarded a prize.

The media may randomly award prizes to players, independent of the outcome of gaming apparatus 20 (see FIG. 1A). For example, the media may be at least partially preprinted and at least one of the media comprises a preprinted prize winning symbol. The media are randomly ordered and stored in storage compartment 504 (see FIG. 14). Media dispenser 111 then dispenses the media in sequential order. A player would win a prize if the media with the prize-winning symbol is dispensed.

The foregoing are examples of some of the uses of the media dispenser and media of the present invention. There are many other possibilities. Printer 510 of media dispenser 111 may be configured to impart information on a media, such as by printing ink, punching holes, or recording information on a magnetic strip. The media may contain information, such as at least one player indicia and at least one prize. The media may also comprise a removable coating or material similar to lottery scratch-off media known in the art. The removable coating may be configured to cover the player indicia, the winning prize, or the game outcome (not shown) to add an element of surprise in the game.

Media dispenser 111 is configured to hold a plurality of media and dispense one or more media when a media-dispensing event occurs. A media-dispensing event may be many different kinds of events. For example, media dispenser 111 may be programmed to dispense media at predefined times or at random times. For example, media dispenser 111 may be programmed to dispense media randomly between certain times when the gaming apparatus 20 is not usually busy. This would provide an incentive for players to play gaming apparatus 20 during these slow periods, thereby potentially increasing revenue generated by the gaming apparatus. In this example, media dispenser 111 may be programmed to dispense media only when gaming apparatus 20 is being played. This would prevent players from simply waiting for media to be printed, collect the media, and then leave.

Media dispenser 111 may also be programmed to dispense media when gaming apparatus 20 is played at a certain rate or when it is played continuously for a period of time. This would provide an incentive for players to play rapidly or to play for a longer period of time in order to obtain media. Media may further be dispensed when game apparatus 20 generates a predetermined outcome. The outcome may be displayed on a display device. For example, spinning reels 22, 23, and 24 (see FIG. 1A) may display a predetermined symbol, such as a bonus symbol, or combination of symbols. This outcome may be determined by a random number generator and pay table algorithm, such as the one discussed above. In this embodiment, the pay table may include a media indicator that causes the controller of game apparatus 20 to transmit a signal to media dispenser 111 that causes the media dispenser to dispense media.

Media dispenser 111 may further be programmed to dispense media when another game apparatus generates a particular outcome. Another gaming device physically separated from media dispenser 111 may produce a particular outcome. For example, in FIG. 1C, one of the gaming apparatus 20 may generate a predetermined result and transmit a message to all of the gaming apparatus 20 in communication with it to dispense media. This may be performed to reward all players at a group of gaming devices when one of the players achieves a predetermined result.

Next, media may be dispensed when display device 11 generates a predefined outcome. For example, if display device 11 selects a particular prize ball, perhaps a prize ball that includes a "media" symbol, media dispenser 111 may dispense a media.

Central system 516 may cause media dispenser 111 to dispense a media. Central system 516 may be any of a large number of systems that are well known in the art. Central system 516 may be programmed to transmit a signal to media dispenser 111 upon the occurrence of a predefined event that instructs the media dispenser to dispense a media. For example, central system 516 may be a progressive prize system and the media dispensed by the media dispenser 111 may be used by the player to collect a progressive prize.

In certain embodiments, central (and/or remote) system 516 performs at least some of the functions performed by controller 76 and/or controller 82. For example, central system 516 may contain a random number generator or database of game outcomes. Rather than each gaming device 10 producing a game outcome, a gaming device 10 could query central system 516 in order to obtain a game outcome. Central system 516 may control what is displayed in prize display 14. Alternatively, central system 516 could communicate a game outcome to gaming device 10. A local processor, such as controller 76 and/or controller 82, could then determine what to display in prize display 14. Central system 516 could also determine the game outcome for gaming device 20, such as the indicia displayed on reels 22–24, and/or the prize ball 92 displayed in display 14. Central system 516 may also control when media 11, and what type of media 111, are dispensed to a player. This method of operation may be useful in ensuring regulatory compliance in certain jurisdictions.

Player tracking system 518 may cause media dispenser 111 to dispense a media. Player tracking systems are well known in the art as a means for tracking the play of players and for rewarding them for their play. Many such systems are well known in the art. Player tracking system 518 may be programmed to transmit a message to media dispenser 111 to dispense a media to a player when the player qualifies under predefined criteria.

Instant Lottery Machine

Figure 15:
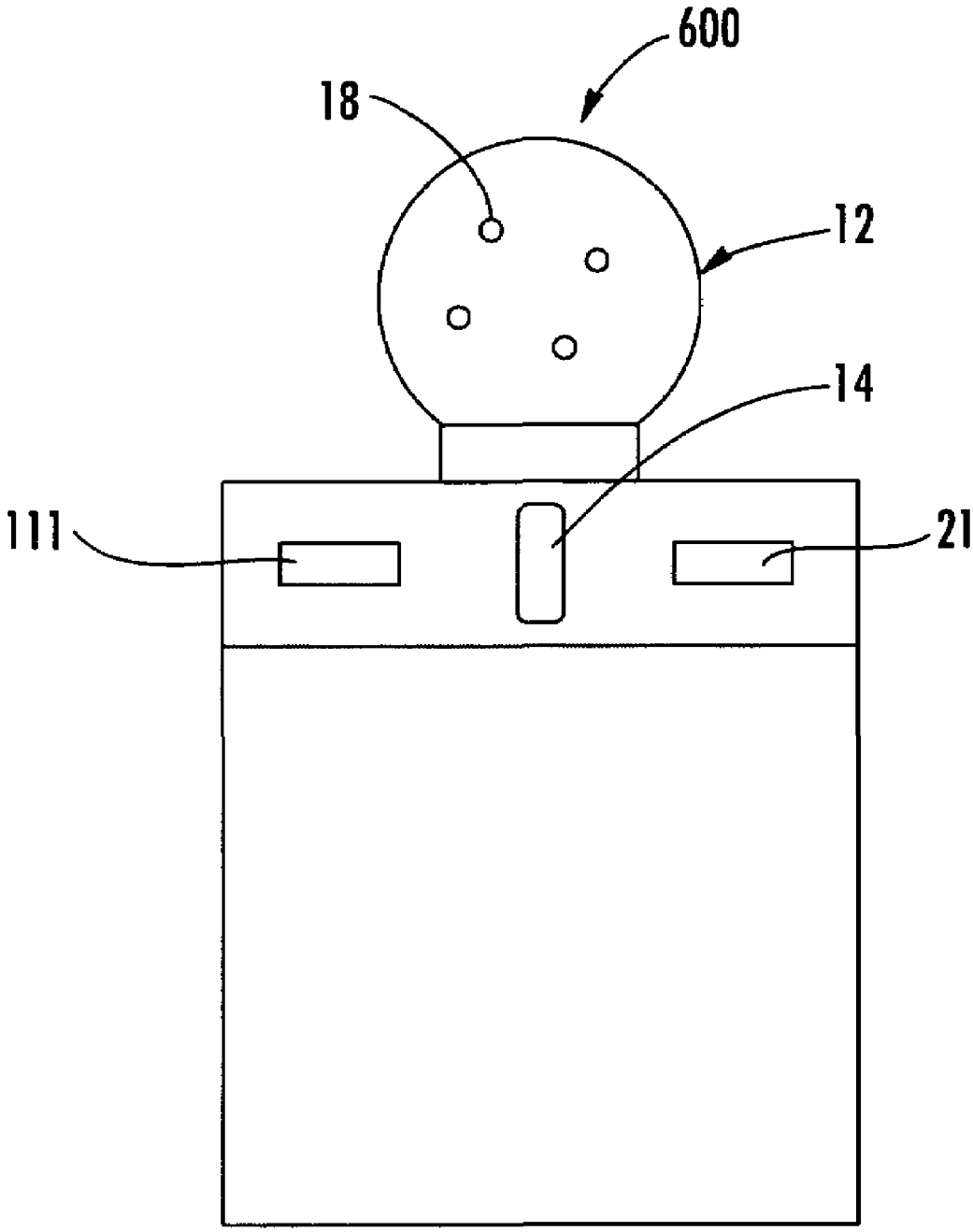
FIG. 15 is substantially a front view of another embodiment of the present invention.

FIG. 15 discloses another gaming device embodiment 600. Gaming device 600 comprises similar components described above. However, gaming device 600 is preferably a stand-alone gaming device, which means it is configured to operate without gaming apparatus 20 shown in previous figures. Gaming device 600 preferably comprises jumbled ball display 12, display balls 18, prize balls (described above and not shown in FIG. 14), prize ball holder (described above and not shown in FIG. 14), an agitator (described above and not shown in FIG. 14), prize display 14, currency acceptor 21, and media dispenser 111 (shown in FIGS. 1A, 14, and 15). A video display device 400 that is described above may be used instead of jumbled ball display 12 and may provide an image of jumbled display balls instead of actual or physical display balls.

Figure 16:
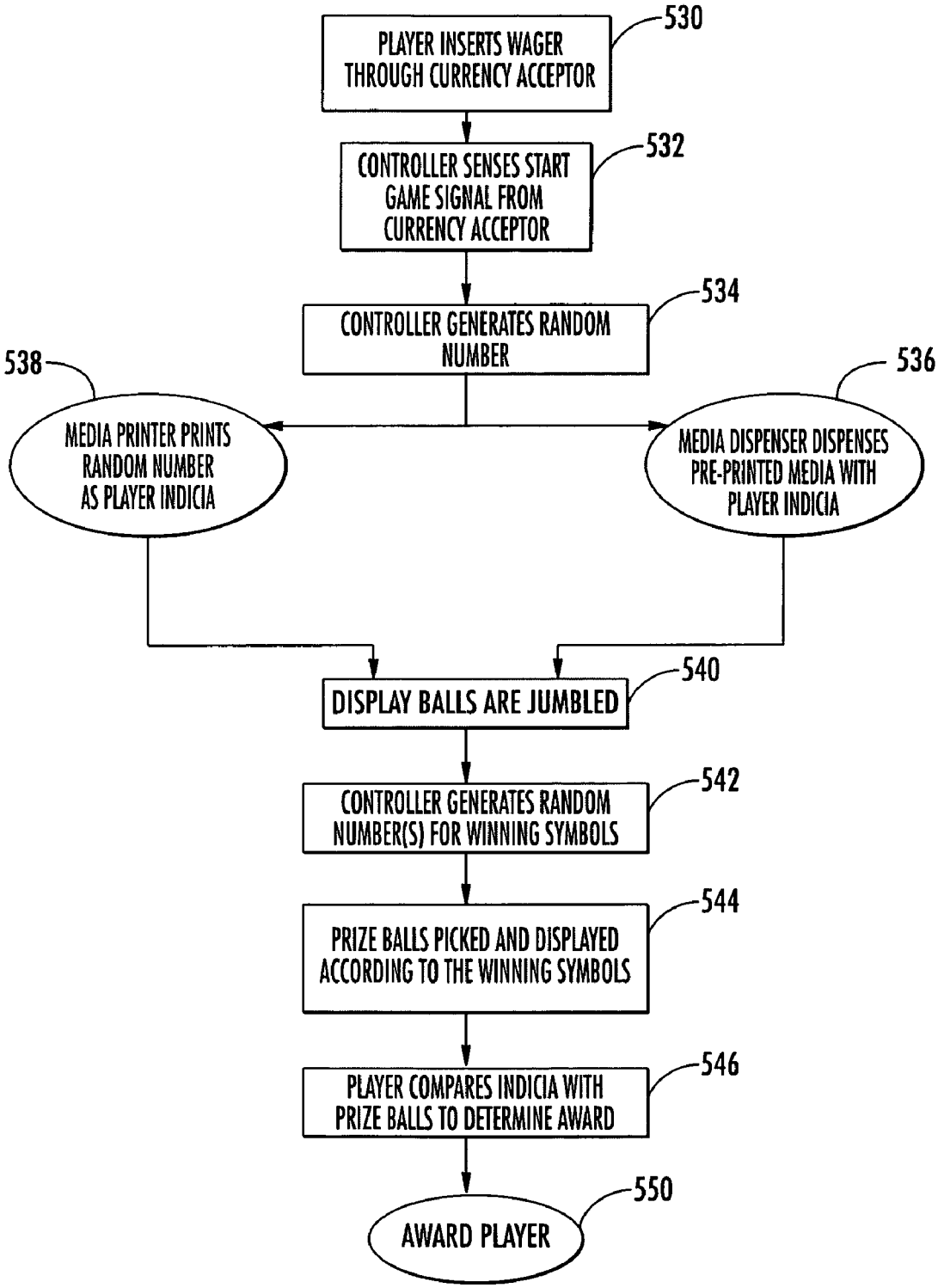
FIG. 16 is substantially a flowchart showing how a game may be conducted on the gaming device embodiment of FIG. 15.

FIG. 16 depicts a game play method that may be conducted on gaming device 600 shown in FIG. 15. At step 530, the player inserts a wager through currency acceptor 21 (not shown). The wager may of course be in various forms known in the art, such as coins, paper currency, and credits from bank cards or credit cards. The wager may also be introduced to gaming device 600 in many other forms besides the currency acceptor, such as wire-transfers or electronic transmissions. Currency acceptor 21 preferably sends a start game play signal to the controller, which consequently detects said signal at step 532. Other methods known in the art may be used to signal the start of game play, such as a player-activated button or handle.

The controller (which may be central system 516) may generate random number (s) at step 534. The controller may cause the printer to print the random number(s) or symbols on the media to represent the player's indicia at step 538. Alternatively, at step 536, the controller may cause the media dispenser to dispense a media that is pre-printed with the player's indicia. The player may have to remove any removable coating from the media, depending on the type of media being used. After the player receives the indicia, the display balls are jumbled or images of jumbled display balls are shown to the player at step 540. The controller then generates random number(s) to generate winning symbols at step 542. Alternatively, the media 111 dispensed to the player may determine the winning symbols. At step 544, the prize balls are picked and displayed according to the winning symbols. At step 546, the player or gaming device 600 may determine whether the player's indicia corresponds to the winning symbols, which may result in a corresponding award. At step 550, the player is awarded any prize won.

It is noted that the flowchart in FIG. 16 shows only one possible embodiment. Some of the steps in the flowchart may be varied, changed in order, or eliminated and still fall within the scope of the present invention.

Figure 17:
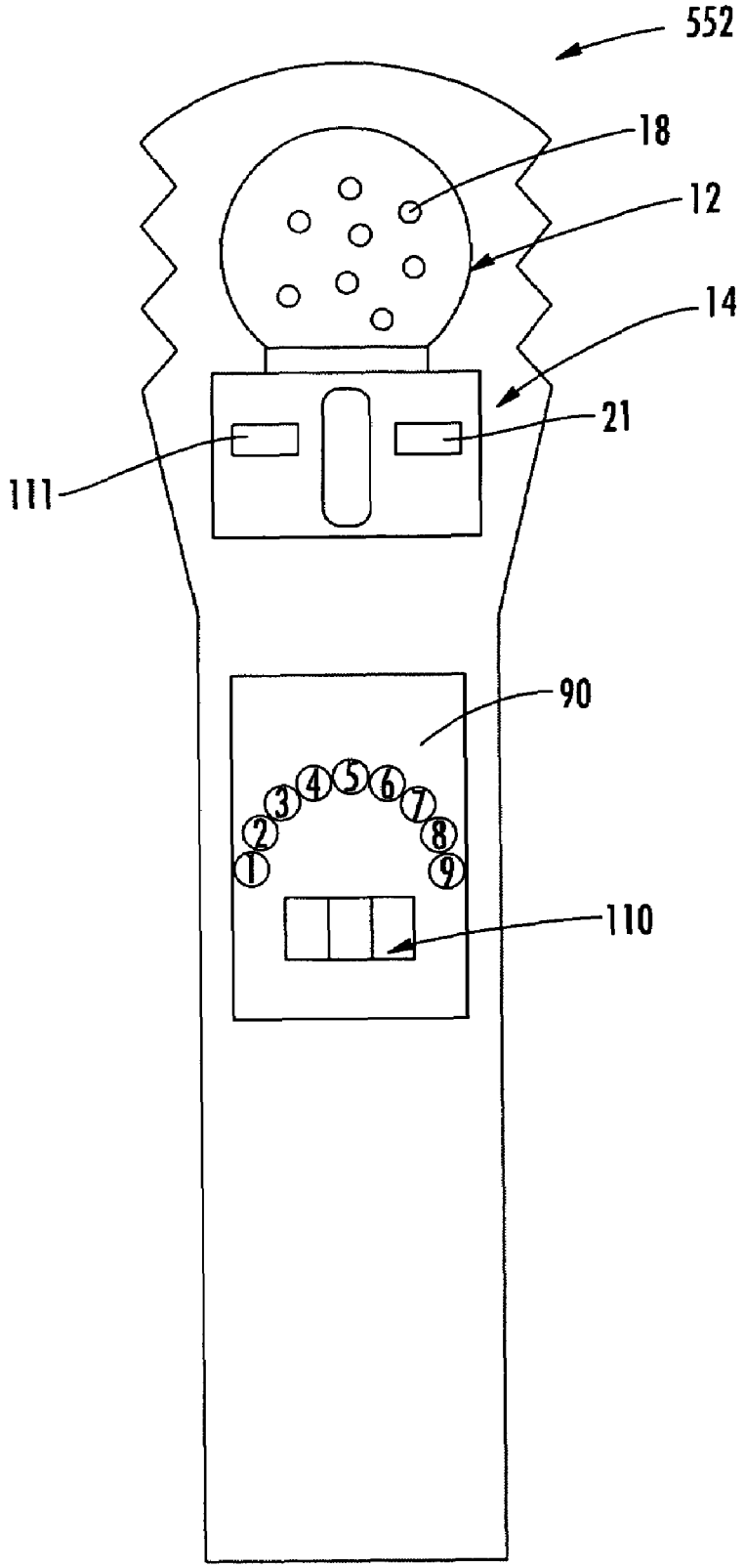
FIG. 17 is substantially a front view of another embodiment of the present invention having an input device that allows a player to pick at least one indicia.

FIG. 17 shows another gaming device embodiment 552, which is similar to the gaming device embodiment 600 in FIG. 15, except for the addition of display 110 (already discussed above) and input device 90. As discussed above, display 110 may also be a large variety of devices known in the art, such as a video display or an LED display. Display 110 preferably shows the player's indicia. Input device 90 may allow a player to select at least one indicia. Input device 90 may be in form of any large variety of input devices known in the art, such as a keyboard, a touch screen, a joystick, a mouse, a microphone and voice recognition software, and an electronically connected button. Gaming device 552 preferably comprises jumbled ball display 12, display balls 18, prize balls (described above and not shown in FIG. 17), prize ball holder (described above and not shown in FIG. 17), an agitator (described above and not shown in FIG. 17), prize display 14, prize ball display 30, currency acceptor 21, and media dispenser 111 (shown in FIGS. 1A, 14, and 15). A video display device 400 that is described above may be used instead of jumbled ball display 12 and may provide an image of jumbled display balls instead of actual or physical display balls.

Figure 18:
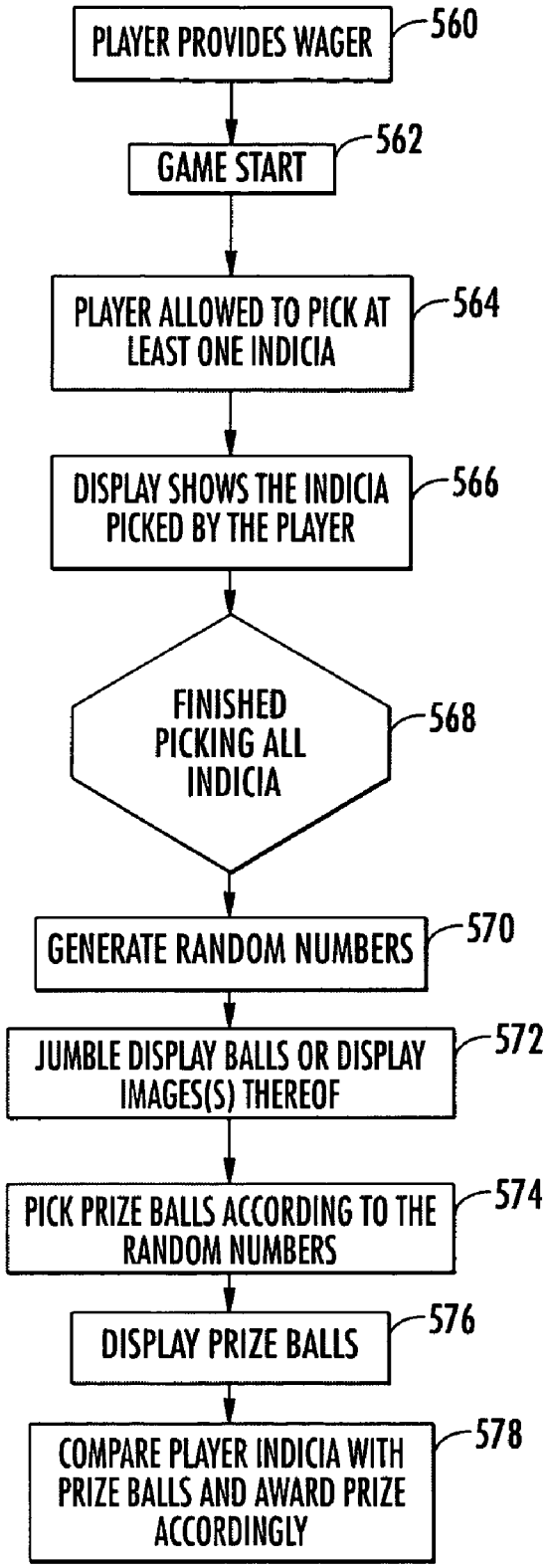
FIG. 18 is substantially a flowchart showing how a game may be conducted on the gaming device embodiment of FIG. 17.

FIG. 18 shows the steps involved in a game that may be conducted on the gaming device shown in FIG. 17. At step 560, the player provides the requisite amount to play the game. The game starts at step 562, and the controller activates the input device to allow the player to pick at least one indicia at step 564. The display preferably shows the indicia selected by the player at step 566. Note that the indicia may also be shown to the player via a media dispensed from media dispenser 111. In other embodiments, indicia may either be presented on display 110 alone, video display device 400, or indicia may be presented on combinations of display 110, video display device 400, and media.

At step 568, the gaming device queries whether the player has picked the required number of indicia. If the player has not picked the required number, the input device or the display prompts the player to select another indicia until the required number of indicia has been selected. Once the required number of indicia has been selected, at step 570, the controller generates random number(s). The display balls are then jumbled or images of jumbled balls are shown at step 572, depending on the jumbled ball display embodiment. At step 574, the controller randomly selects at least one prize ball according to the random number(s). At step 576, the selected prize ball(s) are preferably displayed on the prize ball display.

In other embodiments, winning prize balls or symbols are printed on media by media dispenser 111 and dispensed to the player. Winning prize balls or symbols printed on media may also be covered by removable coating. In yet other embodiments, winning prize balls or symbols may either be presented on display 110 alone, video display device 400 alone, prize display 14 alone, new media (not shown) alone, or in combinations of display 110, video display device 400, and media. Winning prize balls or symbols may also be presented on media containing player's indicia in which case media 508 is preferably presented only after winning prize balls are selected.

At step 578, the player may be awarded a prize if the player's indicia corresponds to the selected prize ball symbols. For example, if the player received 10,10, and 20 and the gaming device selected and displayed prize balls having 10, 10, and 20, then the player would win. In alternative embodiments, the player is awarded a prize if a requisite number of matches between the player's indicia and the selected prize ball exist. The player may also be awarded a prize if the player's indicia match the selected prize ball symbol and order. Next, the player may be awarded an additional prize for every match between the player's indicia and the selected prize ball. In another embodiment, the player may be awarded a progressive prize if a requisite match exists between the player's indicia and the selected prize ball.

It is noted that the flowchart in FIG. 18 only shows only one possible embodiment. Some of the steps in the flowchart may be varied, changed in order, or eliminated and still fall within the scope of the present invention.

CONCLUSION

It can now be seen that the present invention solves many of the problems associated with the prior art. The present invention provides a gaming device that utilizes a highly visible display device that may be used with a primary game or a bonus game. The present invention provides a display device that utilizes physical objects in the form of a jumbled ball display device that is similar to the well-known game of Keno and other games that utilize jumbled balls. The present invention provides a display device that eliminates environmental influences on the outcome of the game. The present invention provides a display device that reduces the risk of tampering, requires no human operators, and requires little maintenance.

Although the description above contains many specifications, these should not be construed as limiting the scope of the invention but as merely providing illustrations of some of the presently preferred embodiments of this invention. The specification, for instance, makes reference to bonus prizes. However, the present invention is not intended to be limited to bonus prizes. Rather it is intended that the present invention can be used independently as a stand-alone game. Thus, the scope of the invention should be determined by the appended claims and their legal equivalents rather than by the examples given.

What is claimed is:

1. A method of playing a game, the method comprising, not necessarily in the order shown:

(A) providing a jumbled ball display, the display comprising a container and a plurality of display balls in the container, the container allowing the player to see the display balls;

(B) jumbling the display balls in the container, the jumbling of the display balls in the container having no effect on an outcome of the game;

(C) providing a plurality of prize balls;

(D) selecting at least one prize ball to convey the outcome of the game; and (E) providing at least one media to the player, wherein the media provides information relevant to an outcome of the game.

2. The method of claim 1, further comprising:

(A) allowing the player to select at least one indicia using an input device; and (B) awarding the player a prize based on a comparison of the selected indicia and the selected prize ball.

3. The method of claim 2, wherein the selected prize ball comprises at least one symbol, further comprising awarding a prize to the player if at least one indicia selected by the player corresponds to the symbol of the selected prize ball.

4. The method of claim 3, further comprising providing at least one secondary prize, selecting a second prize ball, and awarding the secondary prize in addition to the prize awarded in claim 3 if an indicia selected by the player corresponds to the second prize ball.

5. The method of claim 2, wherein a plurality of prize balls are selected in a first order, the plurality of prize balls comprising symbols, wherein the player is allowed to select a plurality of indicia in a second order, the method further comprising awarding a prize to the player if the plurality of player selected indicia and second order correspond to the symbols and first order of the selected prize balls.

6. The method of claim 2, further comprising awarding a progressive prize if a predetermined number of indicia selected by the player match a predetermined number of prize balls.

7. The method of claim 1, further comprising randomly selecting at least one indicia and recording the indicia on the media.

8. The method of claim 7, wherein the media comprises a removable coating, the removable coating being adapted to cover at least a portion of the media.

9. The method of claim 7, wherein a plurality of prize balls are selected in a sequence, the plurality of prize balls comprising symbols, wherein a plurality of indicia are randomly selected in an order, the method further comprising awarding a prize to the player if the plurality of randomly selected indicia and sequence correspond to the symbol and order of the selected prize balls.

10. The method of claim 7, wherein the selected prize ball comprises at least one symbol, further comprising awarding a prize to the player if at least one randomly selected indicia corresponds to a symbol of the selected prize ball.

11. The method of claim 10, further comprising providing at least one secondary prize; allowing the player to select a second indicia, selecting a second prize ball, and awarding the secondary prize in addition to the prize awarded in claim 10 if an indicia selected by the player corresponds to a symbol of the second prize ball.

12. The method of claim 7, further comprising awarding a progressive prize if a predetermined number of indicia selected by the player match a predetermined number of the symbols of the selected prize balls.

13. The method of claim 1, further comprising having a central computer system determine the game outcome.

14. The method of claim 1 wherein the container and the display balls are video representations.

15. The method of claim 1, wherein the media provided to the player determines the game outcome.

16. A gaming device, the gaming device comprising:

(A) a game apparatus, the game apparatus being adapted to allow a player to play a game;

(B) a jumbled ball display device, the display device comprising:

(a) a plurality of display balls;

(b) at least one container, the container being adapted to hold the display balls, the container having at least one portion that is at least partially transparent, wherein the player may view the balls in the container; and (c) at least one agitator, the agitator being adapted to agitate the display balls inside of the container, wherein the jumbled ball display device does not affect the outcome of the game played on the game apparatus;

(C) a prize display in communication with the game apparatus, the prize display being adapted to select a prize ball to convey the outcome of the game and display the selected prize ball; and (D) a media dispenser in communication with the game apparatus, the media dispenser being configured to dispense media to the player.

17. The gaming device of claim 16, wherein the media comprises at least one indicia displayed thereon.

18. The gaming device of claim 17, wherein at least one indicia is recorded on the media after the media is placed in the media dispenser.

19. The gaming device of claim 17, wherein at least one indicia is recorded on the media before the player plays a game on the game apparatus.

20. The gaming device of claim 16, wherein the media comprises an award notification displayed thereon.

21. The gaming device of claim 20, wherein the award notification is recorded on the media after the media is placed in the media dispenser.

22. The gaming device of claim 20, wherein the award notification is recorded on the media before the player plays a game on the game apparatus.

23. The gaming device of claim 16, wherein the gaming apparatus is configured to allow the player to redeem an award.

24. The gaming device of claim 16, wherein the game apparatus is in communication with a central computer system, the central computer system determining the game outcome.

25. The gaming device of claim 16 wherein the container and prize balls are video representations on a video display and the agitator comprises a processor in communication with the video display.

26. The gaming device of claim 16 wherein the media dispensed to the player determines the game outcome.

27. A gaming device, comprising:

(A) a plurality of display balls;

(B) at least one container, the container holding the display balls, the container having at least one portion that is at least partially transparent, wherein the display balls in the container are visible to a player;

(C) at least one prize ball, the prize ball being configured to convey a game outcome, the prize ball being further configured to create an illusion to the player that the display ball conveys the game outcome;

(D) at least one prize ball holder, the prize ball holder being adapted to hold the prize ball;

(E) a controller in communication with the prize ball holder, the controller selecting at least one prize ball in the prize ball holder; and (F) a media dispenser, the media dispenser being adapted to dispense media to the player.

28. The gaming device of claim 27, further comprising an input device, the input device allowing the player to select an indicia.

29. The gaming device of claim 28, further comprising a display device, wherein the input device and the display device are in communication with the controller, wherein the display device is configured to display the player selected indicia to the player.

30. The gaming device of claim 27, wherein the media comprises a removable coating, the removable coating covering at least a portion of the media.

31. The gaming device of claim 27, wherein at least one indicia is recorded on the media before the player plays a game.

32. The gaming device of claim 27, wherein at least one indicia is recorded on the media after the media is placed in the media dispenser.

33. The gaming device of claim 27, wherein the controller is in communication with a remote computer system, the remote computer system determining the game outcome.

34. The gaming device of claim 27, wherein the container and the prize balls are video representations.

35. The gaming device of claim 27 wherein the media dispensed to the player determines the game outcome.

36. The gaming device of claim 35 further comprising a media reader in communication with the controller, wherein the media directs the controller to display a particular prize ball.

37. A method of playing a game, the method comprising, not necessarily in the order shown:

(A) providing a container and a plurality of display balls in the container, the container allowing a player to see the display balls;

(B) dispensing at least one media to the player, the media comprising at least one indicia;

(C) jumbling the display balls in the container;

(D) providing a plurality of prize balls, the prize balls being configured to convey a game outcome, the prize balls being further configured to create an illusion to the player that the display balls convey the game outcome;

(E) selecting at least one prize ball using a controller; and (F) comparing the indicia with the selected prize ball to determine an award.

38. The method of claim 37, wherein the indicia on the media is pre-printed.

39. The method of claim 37, wherein the indicia is randomly selected and recorded on the media before the media is placed in the media dispensed.

40. The method of claim 37, wherein the media comprises a removable coating, the removable coating covering at least a portion of the media.

41. The method of claim 37, wherein the selected prize ball comprises at least one symbol, further comprising awarding a prize to the player if the indicia displayed on the media corresponds to the symbol on the selected prize ball.

42. The method of claim 41, further comprising providing at least one secondary prize, selecting a second prize ball comprising at least one symbol, and awarding the secondary prize in addition to the prize awarded in claim 37 if the symbol appearing on the second prize ball matches an indicia on the media dispended to the player.

43. The method of claim 37, wherein a plurality of prize balls are selected in an order, the plurality of prize balls comprising symbols, wherein the media comprises a plurality of indicia having an order, the method further comprising awarding a prize to the player if the plurality of indicia correspond to the symbols and order of the selected prize balls.

44. The method of claim 37, further comprising awarding a progressive prize if a predetermined number of indicia on the media dispensed to the player match a predetermined number of prize balls.

45. The method of claim 37 wherein the controller is in communication with a central computer system, the central computer system determining the game outcome.

46. The method of claim 37 wherein the container and prize balls are video representations.

47. The method of claim 37 wherein the media dispensed to the player determines the game outcome.

48. The method of claim 37 further comprising:

(A) reading the indicia on the media;

(B) communicating the media indicia to the controller, wherein the selected prize ball is determined by the media indica.

49. A method of playing a game, the method comprising, not necessarily in the order shown:

(A) providing a container and a plurality of display balls in the container, the container allowing a player to see the display balls;

(B) allowing the player to select at least one indicia using an input device;

(C) displaying the selected indicia on a display device, the display device in communication with the input device and configured to display the selected indicia by the player;

(D) jumbling the display balls in the container;

(E) providing a plurality of prize balls, the prize balls being configured to convey a game outcome, the prize ball being further configured to create an illusion to the player that the display ball conveys the game outcome;

(F) selecting at least one prize ball using a controller; and (G) comparing the indicia with the selected prize ball to determine an award.

50. The method of claim 49 wherein the controller is in communication with a central computer system, the central computer system determining the game outcome.

51. The method of claim 49 wherein the container and the prize balls are video representations.

* * * * *